US006047773A

United States Patent [19]

Zeltmann et al.

[11] Patent Number: 6,047,773

[45] Date of Patent: Apr. 11, 2000

[54] APPARATUS AND METHODS FOR STIMULATING A SUBTERRANEAN WELL

[75] Inventors: Thomas A. Zeltmann, Midland; Alireza Baradaran Rahimi, Plano; Colby M. Ross, Carrollton, all of Tex.

[73] Assignee: Halliburton Energy Services, Inc., Dallas, Tex.

[21] Appl. No.: 08/968,934

[22] Filed: Nov. 12, 1997

Related U.S. Application Data

[63] Continuation-in-part of application No. 08/689,547, Aug. 9, 1996, abandoned.

[51] Int. Cl.[7] ..... E21B 43/25

[52] U.S. Cl. ..... 166/281; 166/50; 166/298; 166/300; 166/386; 166/387

[58] Field of Search ..... 166/50, 281, 292, 166/294, 295, 297, 298, 300, 386, 387

[56] References Cited

U.S. PATENT DOCUMENTS

| | | | |
|---|---|---|---|
| 3,437,143 | 4/1969 | Cook | 166/297 X |
| 3,526,280 | 9/1970 | Aulick | 166/386 X |
| 3,743,020 | 7/1973 | Suman, Jr. et al. | 166/292 |
| 3,820,604 | 6/1974 | Karnes | 166/297 |
| 3,830,299 | 8/1974 | Thomeer | 166/281 |
| 4,949,788 | 8/1990 | Szarka et al. | 166/50 X |
| 5,090,481 | 2/1992 | Pleasants et al. | 166/50 X |
| 5,095,987 | 3/1992 | Weaver et al. | 166/50 X |
| 5,103,911 | 4/1992 | Heijnen | 166/297 |
| 5,353,874 | 10/1994 | Manulik | 166/281 |
| 5,484,018 | 1/1996 | Cavender et al. | 166/297 X |
| 5,697,441 | 12/1997 | Vercaemer et al. | 166/285 |

OTHER PUBLICATIONS

Halliburton Services brochure F–3062 (REV) Entitled "Fracturing Technical Data" (undated).

Halliburton Company technical report F–3077 (Revised) Entitled "Limited Entry for Hydraulic Fracturing" dated Mar. 1967.

*Primary Examiner*—George Suchfield

*Attorney, Agent, or Firm*—William M. Imwalle; Marlin R. Smith

[57] ABSTRACT

A method of stimulating a subterranean well permits each desired location within a portion of a well to be isolated from other portions of the well during stimulation operations therein, but does not require lining a portion of the well with casing and cement, and does not require the use of sealing devices, such as inflatable packers, in the well portion. In a preferred embodiment, a stimulation method includes the steps of depositing a barrier fluid in a portion of a well, forming a radially extending opening through the fluid, and flowing stimulation fluids through the opening and into a formation surrounding the portion of the well.

122 Claims, 15 Drawing Sheets

APPARATUS AND METHODS FOR STIMULATING A SUBTERRANEAN WELL

CROSS-REFERENCE TO RELATED APPLICATION

This application is a continuation-in-part of application Ser. No. 08/689,547 entitled METHODS OF STIMULATING A SUBTERRANEAN WELL, filed Aug. 9, 1996, now abandoned.

BACKGROUND OF THE INVENTION

The present invention relates generally to completion operations within subterranean wells and, in a preferred embodiment thereof, more particularly provides apparatus and methods for stimulating a subterranean well.

Stimulation operations in subterranean wells are typically performed in portions of the wells which have been lined with protective casing. In general, the casing within a portion of a well to be stimulated is cemented in place so that fluids are prevented from flowing longitudinally between the casing and the surrounding earth. The cement, thus, permits each portion of the well to be isolated from other portions of the well intersected by the casing.

As used herein, the terms "stimulate", "stimulation", etc. are used in relation to operations wherein it is desired to inject, or otherwise introduce, fluids into a formation or formations intersected by a wellbore of a subterranean well. Typically, the purpose of such stimulation operations is to increase a production rate and/or capacity of hydrocarbons from the formation or formations. Frequently, stimulation operations include a procedure known as "fracturing" wherein fluid is injected into a formation under relatively high pressure in order to fracture the formation, thus making it easier for hydrocarbons within the formation to flow toward the wellbore. Other stimulation operations include acidizing, acid-fracing, etc.

Where the wellbore is lined with casing and cement as described above, the stimulation fluids may be conveniently injected into a specific desired stimulation location within a formation by forming openings radially through the casing and cement at the stimulation location. These openings are typically formed by perforating the casing utilizing shaped explosive charges or water jet cutting. The stimulation fluids may then be pumped from the earth's surface, through tubing extending into the casing, and outward into the formation through the perforations.

Where there are multiple desired stimulation locations, which is generally the case, sealing devices, such as packers and plugs, are usually employed to permit each location to be separately stimulated. It is typically desirable for each stimulation location within a single formation, or within multiple formations, intersected by a well to be isolated from other stimulation locations, so that the stimulation operation for each location may be tailored specifically for that location (e.g., in terms of stimulation fluid pressure and flow rate into the formation at that location). The casing and cement lining the wellbore, along with the sealing devices, prevent loss of stimulation fluids from each desired stimulation location during the stimulation operation. In this manner, an operator performing the stimulation operation can be assured that all of the stimulation fluids intended to be injected into a formation at a desired location are indeed entering the formation at that location.

However, it is, at times, inconvenient, uneconomical, or otherwise undesirable to line a portion of a wellbore with casing and cement, even though it may be known beforehand that stimulation operations will need to be performed in that portion of the wellbore. Although such situations arise in vertical and inclined portions of wellbores as well, they frequently arise in portions of wellbores which are generally horizontal.

Reasons why a generally horizontal portion of a well may not be lined with casing and cement are many. Included among these is the fact that casing and cementing operations are particularly difficult to perform satisfactorily in a generally horizontal portion of a well. For example, it is difficult to completely fill voids with cement between casing and the surrounding earth in a horizontal well portion. In particular, it is common for the cement to settle in a bottom part of the horizontal well portion, leaving a longitudinally extending void or mostly water-filled gap between the cement and the upper part of the horizontal well portion.

It may be easily seen that a longitudinally extending void or gap between the cement and the earth surrounding the wellbore will provide fluid communication along the length of the wellbore. This fluid communication will make it impractical, or at least very difficult, to perform stimulation operations at a desired location within the horizontal well portion isolated from other locations.

For this reason and others, generally horizontal well portions are many times left uncased. If it is desired to perform stimulation operations in an uncased well portion, expensive and oftentimes unreliable sealing devices, such as inflatable packers, are typically used to isolate each stimulation location. The cost of such sealing devices, and the expense of running, setting, and testing them, which frequently must be done multiple times due to their unreliability, often makes their use prohibitive.

From the foregoing, it can be seen that it would be quite desirable to provide a method of stimulating a subterranean well which does not require lining a portion of the well with casing and cement, and which does not require the use of sealing devices, such as inflatable packers, in an uncased portion of the well, but which permits each desired location within the uncased portion of the well to be isolated from other portions of the well during stimulation operations therein. It is accordingly an object of the present invention to provide such a well stimulation method and associated apparatus.

SUMMARY OF THE INVENTION

In carrying out the principles of the present invention, in accordance with an embodiment thereof, a method is provided which utilizes a viscous fluid to isolate desired stimulation locations in a formation intersected by an uncased portion of a subterranean well. Each of the desired stimulation locations are successively or simultaneously selected for flow of stimulation fluids thereinto by forming an opening through the viscous fluid to the desired stimulation location while the remainder of the formation is isolated from the stimulation fluids by the viscous fluid.

In broad terms, a method of stimulating a portion of a subterranean well at axially spaced apart desired stimulation locations therein is provided. The well portion intersects a formation.

The method includes the steps of disposing a viscous fluid within the well portion; forming a radially extending opening through the viscous fluid at a first one of the desired stimulation locations; and flowing stimulation fluids through the opening and into the formation at the first desired stimulation location. The viscous fluid substantially prevents flow of the stimulation fluids into any portion of the formation other than at the first desired stimulation location.

A method of injecting a fluid into successive desired locations in a formation surrounding a subterranean wellbore while preventing the injection of the fluid into other locations in the formation exposed to the wellbore is also provided. The method includes the steps of contacting the formation exposed to the wellbore with a flowable material, the material being capable of flowing within the wellbore and substantially incapable of flowing into the formation; providing a tubular member; disposing an end of the tubular member in the flowable material; forming a first flow passage from the tubular member through the flowable material to a first one of the desired locations in the formation; and flowing the fluid through the tubular member and the first flow passage to the first one of the desired locations.

A method of stimulating a formation intersecting a subterranean well is also provided. The method includes the steps of providing a work string having an end; disposing the work string within the subterranean well; providing a viscous fluid; disposing the viscous fluid in the subterranean well about the work string end, the viscous fluid contacting the formation; providing a tubing string having an end and a cutting head attached to the tubing string end; disposing the tubing string within the work string; positioning the tubing string end relative to the work string end, such that the cutting head extends axially outward from the work string end; forming an opening from the cutting head to the formation through the viscous fluid; and flowing stimulation fluid through the opening to the formation.

Another method of stimulating a formation intersecting a subterranean well is provided. The method comprises the steps of providing a work string having an end and a cutting head attached to the end; disposing the work string within the subterranean well; providing a viscous fluid; disposing the viscous fluid in the subterranean well about the work string end, the viscous fluid contacting the formation; forming a first opening from the cutting head to the formation through the viscous fluid; and flowing stimulation fluid through the first opening to the formation.

Yet another method of stimulating a formation intersecting a subterranean well is provided. The method includes the steps of providing a work string having an end and an axially spaced apart series of seals externally disposed on an outer side surface of the work string; providing a packer having an axially extending seal bore formed therethrough; setting the packer in the well; disposing the work string within the subterranean well, the work string being reciprocably received in the seal bore; providing a viscous fluid; disposing the viscous fluid in the subterranean well about the work string end, the viscous fluid contacting the formation; providing a tubing string having an end and a cutting head attached to the tubing string end; disposing the tubing string within the work string; positioning the tubing string end relative to the work string end, such that the cutting head extends axially outward from the work string end; sealingly engaging one of the seals with the seal bore; forming a first opening from the cutting head to the formation through the viscous fluid; and flowing stimulation fluid through the first opening to the formation.

Still another method of stimulating a formation intersecting a subterranean well is provided. The method includes the steps of providing a work string having an axially spaced apart series of sliding sleeves connected to the remainder of the work string; disposing the work string within the subterranean well; positioning the work string within the subterranean well such that each of the sliding sleeves is radially opposite a desired stimulation location in the formation; providing a viscous fluid; disposing the viscous fluid in the subterranean well about the work string end, the viscous fluid contacting the formation; providing a tubing string having an end and a cutting head attached to the tubing string end; disposing the tubing string within the work string; positioning the tubing string end relative to the work string end, such that the cutting head is aligned with a first one of the sliding sleeves; opening the first one of the sliding sleeves; forming a first opening from the cutting head to the formation through the first one of the sliding sleeves and the viscous fluid; and flowing stimulation fluid through the first opening to the formation.

Another method of stimulating a formation intersecting a subterranean well is provided by the present invention. The method includes the steps of providing a tubular string having an end; disposing the tubular string within the subterranean well, thereby forming an annulus between the tubular string and the well; providing a viscous fluid; disposing the viscous fluid in the subterranean well about the tubular string end in a first portion of the annulus, the viscous fluid contacting the formation; sealingly engaging the tubular string with the subterranean well, thereby isolating the first annulus portion from a second annulus portion; forming a first opening to the formation through the viscous fluid; and flowing stimulation fluid through the first opening to the formation.

Still another method is provided by the principles of the present invention. Broadly stated, the method includes the steps of disposing a viscous fluid within a portion of a subterranean well and flowing stimulation fluid through the viscous fluid and into a formation intersected by the well. In one aspect of the method, multiple locations within the well portion may be simultaneously stimulated. In another aspect of the method, multiple locations may be stimulated in succession without withdrawing a tubing string used to convey the stimulation fluids from the well.

Apparatus provided by the principles of the present invention include jet subs specially configured to permit simultaneous stimulation of multiple locations within a well. In one aspect of the invention, a jet sub includes a jet orifice plugging member which is dissolvable in the stimulation fluid. Thus, multiple orifices may be opened substantially simultaneously upon delivery of the stimulation fluid to multiple jet subs. In another aspect of the invention, a jet sub includes a jet orifice plugging member which is retained by a shear member. Upon internal pressurization of multiple jet subs to shear the shear members, multiple orifices may be simultaneously opened for delivery of stimulation fluid.

The use of the disclosed methods and apparatus permits convenient and economical stimulation of uncased portions of subterranean wells. The methods do not require casing and cement in the uncased portions, nor do they require the use of sealing devices, such as inflatable packers in the uncased portions.

DETAILED DESCRIPTION

Illustrated in FIGS. 1–6 is a method 10 which embodies principles of the present invention. Although the method 10 is representatively illustrated as being performed in a subterranean well 12 having a generally horizontal uncased portion 14 thereof, it is to be understood that the method 10 and other methods described herein may be performed in generally vertical, inclined, or otherwise formed portions of wells, without departing from the principles of the present invention. Additionally, in the following description of the method 10, and other methods incorporating principles of the present invention representatively illustrated in the accompanying figures, directional terms, such as "upward", "downward", "upper", "lower", etc., are used in relation to the methods as depicted in the figures and are not to be construed as limiting the application, utility, manner of operation, etc. of the methods.

Figure 1:
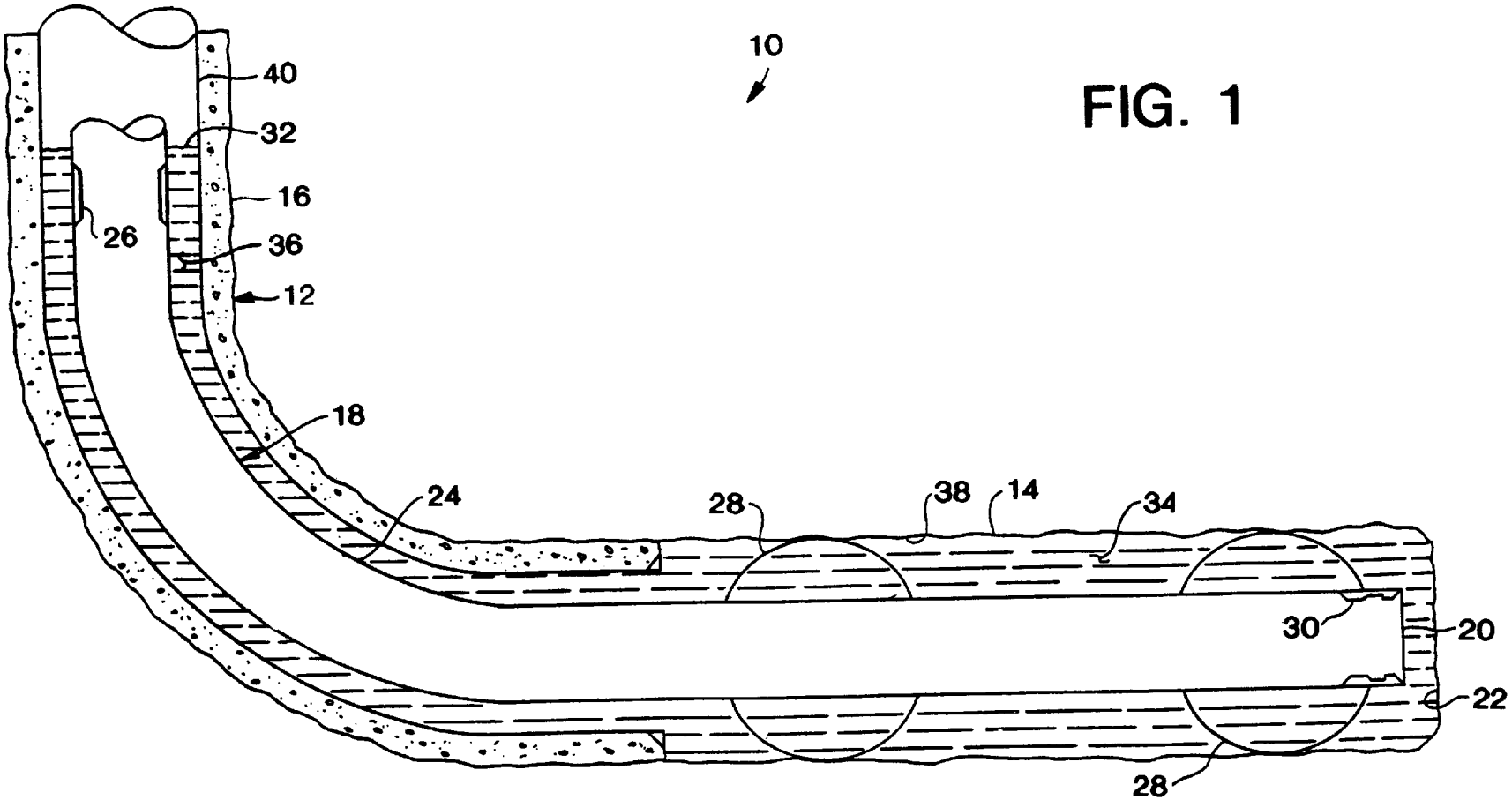
FIG. 1 is a cross-sectional view of a subterranean well having a work string and a viscous fluid disposed therein in accordance with a first method embodying principles of the present invention.

As shown in FIG. 1, the well 12 includes an upper cased portion 16. The generally vertical cased portion 16 extends to the earth's surface. According to conventional practice, the cased portion 16 extends somewhat horizontally at its lower end, facilitating passage of tools, equipment, tubing, etc. from the cased portion 16 into the uncased portion 14. It is to be understood that curvatures, lengths, etc. of the cased portion 16 and uncased portion 14 are as representatively depicted in FIG. 1 for convenience of illustration, and that these portions may actually extend many thousands of feet into the earth, may be differently proportioned, and may be otherwise dimensioned without departing from the principles of the present invention.

A work string 18 is operatively positioned within the well 12 by, for example, lowering the work string into the well from the earth's surface. The work string 18 may be axially positioned relative to the uncased portion 14 by, for example, lowering the work string from the earth's surface until a lower end 20 of the work string touches a lower end 22 of the well 12 and then picking up on the work string a sufficient amount to position the work string as desired. Alternatively, conventional tools, such as gamma ray logging tools, etc., may be utilized to axially position the work string 18 within the well 12.

The work string 18 includes tubing 24, a landing nipple 26, centralizers 28, and a latching profile 30. Preferably, the tubing 24 extends upward to the earth's surface. The relative placement and quantities of each of these components may be altered without departing from the principles of the present invention. Indeed, certain of these components, such as the landing nipple 26, may be eliminated from the work string 18, without departing from the principles of the present invention.

It is well known to those of ordinary skill in the art that various components may be substituted or eliminated without affecting the functionality of a work string, such as work string 18. For example, landing nipple 26 is utilized in the method 10 in substantial part to provide a convenient place to operatively dispose a plug within the work string 18 as will be more fully described hereinbelow. It is well known to ordinarily skilled artisans that it is not necessary to provide the landing nipple 26 in order to dispose a plug within the work string 18 and, thus, the nipple may be eliminated from the work string without significantly affecting the performance of the method 10.

The centralizers 28 operate to radially centralize the work string 18 within the uncased portion 14. For reasons which will become apparent upon consideration of the further detailed description of the method 10 provided hereinbelow, it is desirable for the work string 18 to be radially spaced apart from the uncased portion 14. Although two such centralizers 28 are representatively illustrated in FIG. 1, it is to be understood that any number or type of centralizers may be utilized in the method 10 without departing from the principles of the present invention. For example, the centralizers 28 may be bow spring-type centralizers or spirally-shaped centralizers (such as the type used to enhance distribution of cement in casing cementing operations), which are well known to those skilled in the art, or the method 10 may be performed without utilizing any centralizers.

The latching profile 30 is shown disposed on the work string 18 proximate the lower end 20 thereof. The latching profile 30 is of a conventional type commonly utilized in wellsite operations to locate equipment and tools relative thereto. As representatively illustrated, latching profile 30 is of the type which receives complementarily shaped and radially outwardly extending latches therein. It is to be understood, however, that other latching devices may be utilized in the method 10 without departing from the principles of the present invention. Additionally, as stated hereinabove, it will be readily apparent to an ordinarily skilled artisan that other locating methods may also be utilized in place of a latching device, such as latching profile 30, without departing from the principles of the present invention.

When the work string 18 has been positioned within the well 12 as representatively illustrated in FIG. 1, a viscous barrier fluid 32 is pumped from the earth's surface downward through the tubing 24. The fluid 32 is pumped outward through the end 20 of the work string 18 and into an annulus 34 formed radially between the uncased portion 14 and the work string 18. Additionally, the fluid 32 is preferably pumped upwardly into an annulus 36 formed radially between the work string 18 and the cased portion 16 of the well 12.

The fluid 32 is preferably gelatinous and has properties which substantially prevent its being pumped into a formation 38 surrounding the uncased portion 14 of the well 12. The fluid 32, thus, forms a barrier at the formation 38 where it contacts the formation. Distribution of the fluid 32 within the annulus 34, and surface contact of the fluid with the formation 38 may be enhanced by use of the spirally-shaped centralizers 28 described above.

Additionally, it is preferred that the fluid 32 be acid or enzyme soluble for convenience of cleanup after the stimulation operation. However, in other methods more fully described hereinbelow, where a stimulation operation may utilize acidic fluid, it may not be preferred for a barrier fluid to be readily acid soluble.

A suitable preferred fluid 32 for use in the method 10 is known as K-MAX™, available from Halliburton Energy Services, Inc. of Duncan, Okla. Another suitable preferred fluid 32 is known as MAX SEAL™, also available from Halliburton Energy Services, Inc. These preferred fluids 32 are variously described and claimed in U.S. Pat. Nos. 5,304,620 and 5,439,057, along with methods of preparing the fluids and controlling fluid loss in high permeability formations. The disclosures of these patents are hereby incorporated by reference. Additionally, wellbore operations utilizing the same or similar preferred fluids are disclosed in a pending U.S. patent application Ser. No. 08/685,315, entitled "A METHOD FOR ENHANCING FLUID LOSS CONTROL IN SUBTERRANEAN FORMATION", and a filing date of Jul. 23, 1996, now U.S. Pat. No. 5,680,900. The disclosure of that application is hereby incorporated by reference.

As will be more fully described hereinbelow, the fluid 32 is utilized in substantial part in the method 10 to prevent flow of other fluids into the formation 38 when such flow is not desired, but also to permit such flow when it is desired. Among other features, the method 10 uniquely positions the fluid 32 and work string 18 relative to the formation 38, permits initial stimulation operations therethrough, repositions the work string 18, reconsolidates the fluid 32, permits subsequent stimulation operations therethrough, and permits other operations within the well 12 which enhance the convenience and economics of stimulation operations in the well.

With the well 12 configured as shown in FIG. 1, stimulation operations according to the method 10 are ready to be performed. Preferably, a pressure test is performed before commencement of the stimulation operations by, for example, applying pressure to the annulus 36 at the earth's surface while the tubing 24 is closed off at the earth's surface. Alternatively, a balancing pressure may be applied to the tubing 24 at the earth's surface during the pressure test. The pressure test confirms that the tubing 24 and protective casing 40 lining the cased portion 16 do not leak, and that the fluid 32 substantially fills the annulus 34. Where the preferred gelatinous fluid 32 is utilized, such pressure test will operate to consolidate the fluid, making it relatively impervious to other fluids, and will ensure that the fluid 32 fills substantially all voids which might otherwise be left in the annulus 34. For purposes of the pressure test, the tubing 24 and the annulus 36 above the fluid 32 extending to the earth's surface may be filled with another fluid, such as brine water, mud, etc.

It may now be fully appreciated that the centralizers 28 permit the fluid 32 to contact substantially all of the formation 38 exposed to the annulus 34. The tubing 24 is, thus, not permitted to rest against the formation 38, which might partially prevent contact between the fluid 32 and the formation. It is to be understood that the tubing 24 may be permitted to contact the formation 38 without departing from the principles of the present invention, but that applicants prefer such contact be avoided.

Figure 2:
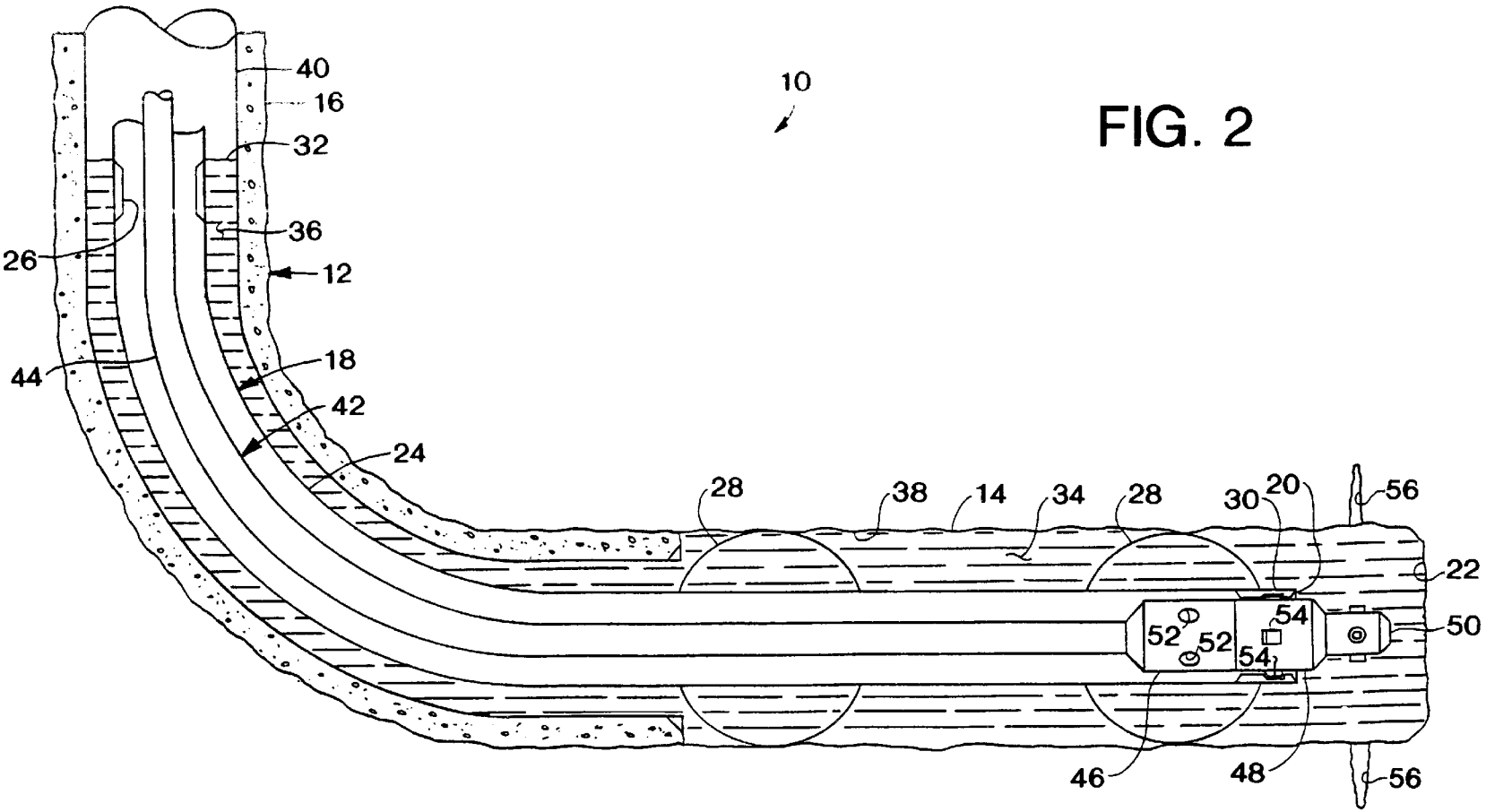
FIG. 2 is a cross-sectional view of the subterranean well of FIG. 1, showing a coiled tubing received in the work string and a hydraulic jet cutter head attached to the coiled tubing extending axially outward from the work string, according to the first method.

Referring additionally now to FIG. 2, the method 10 is shown wherein the work string 18 has been displaced somewhat axially away from the bottom 22 of the well 12. A tubing string 42 is received within the tubing 24 such that it extends partially axially outward through the lower end 20 of the tubing.

Preferably, the tubing string 42 includes coiled tubing 44 which extends to the earth's surface. It is to be understood, however, that other types of tubing may be utilized in the method 10 without departing from the principles of the present invention.

The tubing string 42 also includes, in succession from the tubing 44 axially downward, a recloseable ported sub 46, a latching sub 48, and a cutting head 50. As with the work string 18 described hereinabove, it will be readily apparent to one of ordinary skill in the art that substitutions may be made for some or all of these components, or some or all of these components may be eliminated without departing from the principles of the present invention. For example, the ported sub 46 is included in the tubing string 42 in substantial part to permit flow of stimulation fluids therethrough in a manner which will be more fully described hereinbelow. If, however, it is instead desired to flow stimulation fluids through the work string 18, the ported sub 46 may be eliminated from the tubing string 42.

The ported sub 46 is conventional and is preferably of the type well known to those skilled in the art which permits opening and reclosure of ports 52 formed thereon. Such opening and reclosure of the ports 52 may be accomplished by various operations, depending upon the type of ported sub utilized. For example, the ports 52 may be opened and closed by utilizing a conventional shifting tool (not shown) conveyed into the ported sub 46 on wireline or slickline, or fluid pressure may be applied to the tubing string 42 and/or work string 18 to open or close the ports.

The latching sub 48 permits positive positioning of the tubing string 42 relative to the work string 18. The latching sub 48 has a series of latches 54 projecting radially outwardly therefrom which are capable of operatively engaging the latching profile 30 of the work string 18. In operation, the cooperative engagement between the latching sub 48 and the latching profile 30 preferably determines an amount of the tubing string 42 which extends axially outward from the work string 18. In this manner, the cutting head 50 may be accurately positioned relative to the end 20 of the work string 18.

The cutting head 50 is capable of cutting radially outward through the fluid 32 and into the formation 38. Preferably, the cutting head 50 is a hydraulic jet cutting apparatus, but it is to be understood that other cutting apparatus, such as shaped charges, drills, mills, etc., may be utilized in the method 10 without departing from the principles of the present invention. A suitable hydraulic jet cutting apparatus which may be utilized for the cutting head 50 is known as the HYDRA-JET™ available from Halliburton Energy Services, Inc. of Duncan, Okla. Applicants prefer that the cutting head 50 is a HYDRA-JET™ head capable of cutting approximately 20–24 inches radially outward into the formation 38. Typically, HYDRA-JET™ heads form six or eight holes, such as holes 56 shown in FIG. 2, in a spoke-like pattern. It is to be understood, however, that more or less holes 56 may be formed, and that the cutting head 50 may be rotated during cutting to produce a continuous annular-shaped recess in the formation 38, without departing from the principles of the present invention.

The holes 56 facilitate forming of transversely-oriented fractures in the formation 38 relative to the uncased portion 14 of the well 12. Such transversely-oriented fractures are desired in generally horizontal portions of wells which extend substantially within potentially productive formations. It is to be understood that, in accordance with the principles of the present invention, it is not necessary for the holes 56 to be formed in the formation 38. However, applicants prefer that such holes 56 be formed where fracturing of the formation 38 during stimulation operation is desired.

During forming of the holes 56, if the cutting head 50 is a hydraulic jet cutting apparatus or other fluid cutting apparatus, return circulation of the fluid through the tubing string 24 may be provided by radial clearance between the latching sub 48 and latching profile 30. In this manner, the cutting fluid is not permitted to accumulate in the annulus 34 or to disperse the barrier fluid 32. However, it is not necessary for such return circulation to be provided in the method 10.

After the holes 56 are formed by, for example, the hydraulic jet cutting action of a HYDRA-JFT™ head, the ported sub 46 may be extended axially outward from the end 20 of the work string 18 (by disengaging the latching sub 48 from the latching profile 30), and the ports 52 may be opened to permit flow therethrough of stimulation fluid. Alternatively, the tubing string 42 may be withdrawn from the work string 18 to permit flow of stimulation fluid through the work string.

The stimulation fluid is conventional and may include additives, such as proppant, chemicals, etc., which are useful in fracturing the formation 38, maintaining fractures 58 (see FIG. 3) formed thereby open, etc. Such stimulation fluids are permitted to enter the holes 56 formed in the formation 38 because the cutting head 50 displaces the fluid 32 between the cutting head and the formation when it is cutting thereinto. The fluid 32, however, is operative to prevent flow of the stimulation fluids into other portions of the formation 38.

Note that, if the above-described preferred fluid is used for fluid 32, the stimulation fluids are preferably not acidic, due to the fact that the K-MAX™ and MAX SEAL™ fluids are acid soluble. If it is desired to stimulate the formation 38 with acidic stimulation fluids, another viscous fluid should be used for the fluid 32.

During the flow of stimulation fluids into the formation 38, applicants prefer that sufficient pressure be applied to the annulus 36 at the earth's surface to prevent displacement of the fluid 32 upwardly therein.

Figure 3:
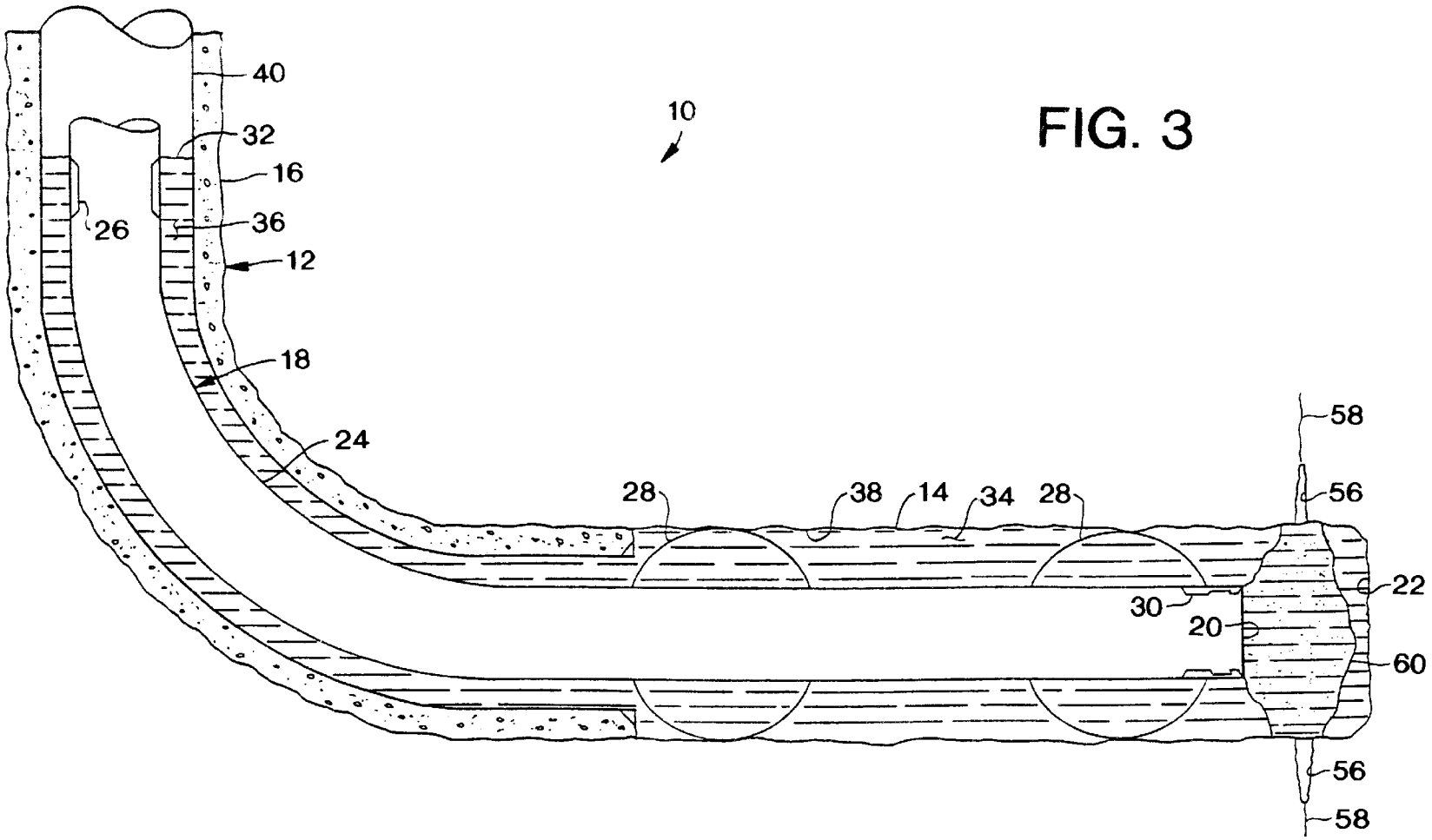
FIG. 3 is a cross-sectional view of the subterranean well of FIG. 1, showing fractures formed in a formation surrounding the well and a temporary plug comprising sand and viscous fluid operatively positioned within the well, according to the first method.

Referring additionally now to FIG. 3, it may be seen that the formation 38 has been fractured, there being fractures 58 extending generally transversely away from the uncased portion 14 of the well 12. Note that FIG. 3 shows the tubing string 42 removed from within the work string 18, as will be the case if the stimulation fluids are flowed through the work string, instead of through the ported sub 46 on the tubing string.

After the well 12 has been stimulated as desired by, for example, forming the fractures 58 in the formation 38, a relatively small quantity of the fluid 32 mixed with sand may be spotted opposite the openings 56. The mixed fluid 32 and sand forms a viscous plug 60 which is capable of preventing subsequent flow of fluids into the openings 56 and fractures 58, and generally into the formation 38 adjacent the openings 56. Although not shown in FIG. 3, the plug 60 may also extend into the openings 56.

The plug 60 may be delivered to the uncased portion 14 by the same means used to convey the stimulation fluids, e.g., the tubing string 42 or the work string 18. For efficiency of operation, applicants prefer that the plug 60 be "tailed-in" with the stimulation fluids, so that the plug is delivered to the well 12 immediately following the stimulation fluids. In this manner, a pressure increase may be detected at the earth's surface when the plug 60 is in place and preventing further fluid flow into the formation 38.

It is to be understood that it is not necessary for the plug 60 to be utilized in the method 10. As will be more fully described hereinbelow, the fluid 32 in the annulus 34 may be reconsolidated to fill any voids therein, without the need for depositing a separate plug 60 therein. Applicants prefer utilization of the plug 60, however, because it is relatively easy to place the plug immediately after the stimulation step and the sand mixed therein provides an enhanced strength matrix in this area of the uncased portion 14 which has been significantly disturbed by flow of jet cutting and stimulation fluids therethrough.

Figure 4:
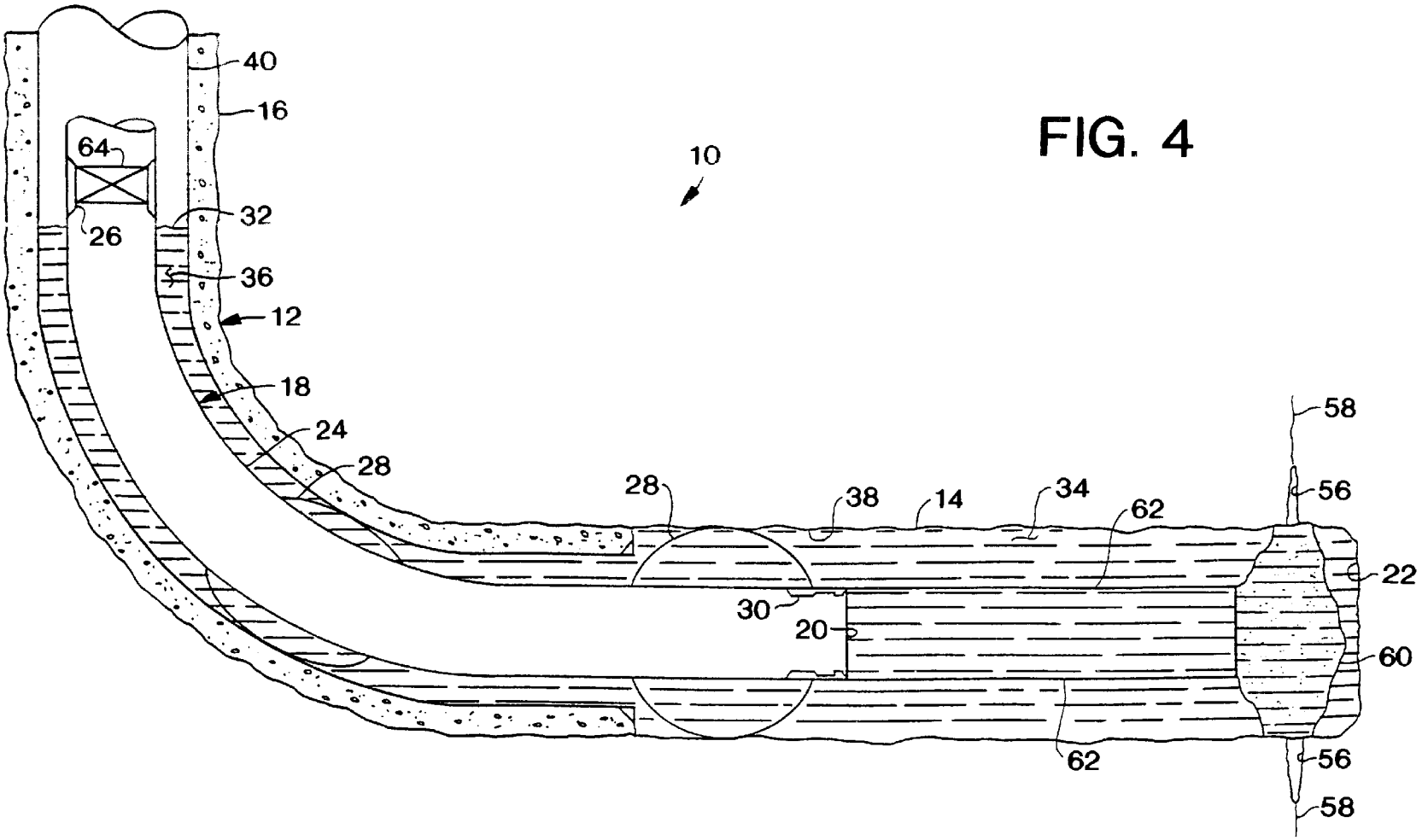
FIG. 4 is a cross-sectional view of the subterranean well of FIG. 1, showing the work string repositioned within the well and a retrievable plug operatively installed within a nipple in the work string, according to the first method.

Referring additionally now to FIG. 4, the work string 18 has been displaced axially upward within the well 12, thereby displacing the end 20 axially away from the plug 60. The work string 18 is so displaced in order to position the work string relative to the uncased portion 14 for performing another stimulation operation (see FIG. 5, wherein the cutting head 50 is positioned relative to the end 20 of the work string 18 for performing another stimulation operation). Initially, avoid (indicated in FIG. 4 by solid outline 62) is created in the fluid 32 between the plug 60 and the end 20 of the work string 18 when the work string is so displaced.

The void 62 is filled by applying pressure to the annulus 36 at the earth's surface to flow the fluid 32 downward in the annulus 36 and into the uncased portion 14. For this purpose, the fluid 32 was initially stored in the annulus 36. Applicants prefer that, depending on the number of stimulation locations desired, the length and diameter of the work string 18, the length and diameter of the uncased portion 14, etc., the fluid 32 should initially extend sufficiently upwardly into the annulus 36 to fill all such voids 62 to be created during stimulation of the well 12.

When pressure is applied to the annulus 36 to fill the void 62 with the fluid 32, a sufficient pressure may also be applied to the work string 18 to prevent the fluid 32 from flowing upwardly into the work string. Alternatively, or subsequent to such application of pressure to the work string 18, a retrievable plug 64 may be operatively installed in the landing nipple 26. By installing the plug 64 in the landing nipple 26, pressure may be maintained on the annulus 36 for an extended period of time. Where K-MAX™ or MAX SEAL™ is utilized for the fluid 32, such application of pressure thereto will not only cause the fluid to fill the void 62, but will also cause the fluid to reconsolidate so that no interfaces are present between the fluid initially delivered to the annulus 34 and the fluid which subsequently fills the void 62. This lack of interfaces in the reconsolidated fluid 32 (which prevents flow of other fluids through such interfaces) is a reason that applicants prefer use of the K-MAX™ or MAX SEAL™ for the fluid 32.

Preferably, the pressure is applied to the annulus 36 for an extended period of time, for example, approximately eight hours, to ensure that the void 62 is filled, the fluid 32 is reconsolidated (if the preferred fluid is utilized), and that no leaks are present. When the period of time has elapsed, the pressure is removed from the annulus 36 and the plug 64 is retrieved from the work string 18. At this point, another stimulation operation may be performed.

Note that it is not necessary for the void 62 to be filled with the fluid 32 prior to any subsequent stimulation operations in the uncased portion 14, since the plug 60 isolates the openings 56 from any other fluids which may be flowed through the work string 18 or tubing string 42 thereafter. Applicants, however, prefer that the void 62 be filled with the fluid 32 to ensure that extraneous fluid paths are not left in the uncased portion 14 between stimulation operations. Note, also, that the void 62 may be filled alternatively by flowing a relatively small quantity of the fluid 32 through the work string 18 after the plug 60 has been delivered to the uncased portion 14 and after the work string has been displaced. And, finally, note that one of the representative centralizers 28 is shown having entered the casing 40 when the work string 18 was displaced relative to the uncased portion 14. It is to be understood that the centralizers 28 may be otherwise spaced apart so that none of the centralizers 28 enters the casing 40 when the work string 18 is displaced without departing from the principles of the present invention.

Figure 5:
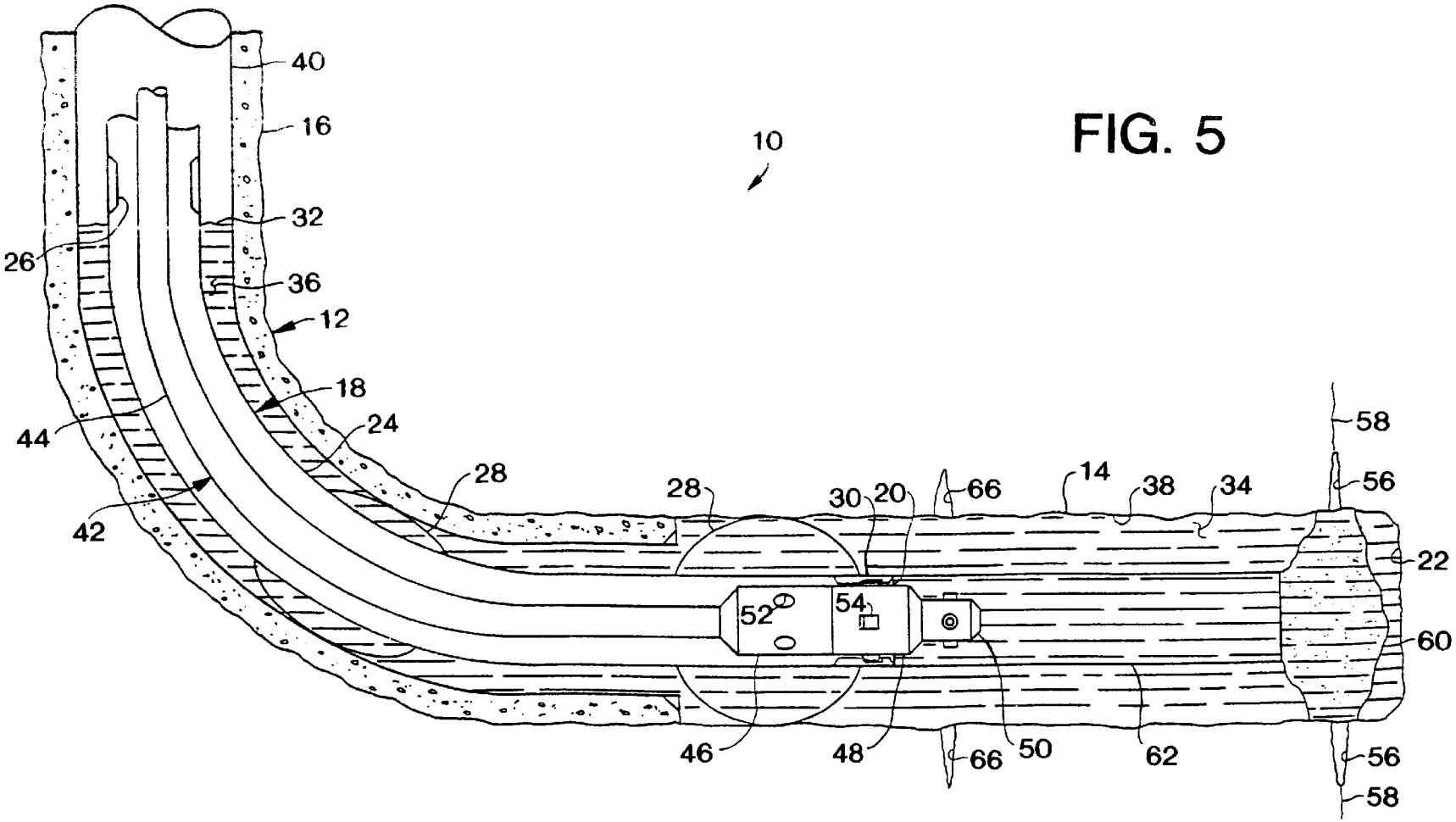
FIG. 5 is a cross-sectional view of the subterranean well of FIG. 1, showing the coiled tubing received in the repositioned work string and the hydraulic jet cutter head extending axially outward from the work string, according to the first method.

Referring additionally now to FIG. 5, the tubing string 42 is shown again received within the work string 18. The latching sub 48 is latched into the latching profile 30 and the cutting head 50 extends axially outward from the end 20 of the work string 18. The cutting head 50 has formed holes 66 into the formation 38, similar to the previously-formed holes 56.

It will be readily appreciated by one of ordinary skill in the art that any desired number of axially spaced apart stimulation operations, corresponding, for example, to axially spaced apart holes 56 and 66, may be located within the uncased portion 14 according to the principles of the method 10. In one aspect of the present invention, a first set of holes, such as holes 56, may be formed, stimulation fluids may be flowed into the formation 38, the work string 18 may be displaced relative to the uncased portion 14, a second set of holes, such as holes 66, may be formed, stimulation fluids may be flowed into the formation, the work string may be displaced relative to the uncased portion, a third set of holes may be formed, etc., until a desired number of stimulation locations are achieved.

Placement of the plug 60, and similar other plugs subsequent to corresponding other stimulation operations, and filling of voids, such as void 62 and other similar voids formed by displacement of the work string, prevent unwanted flow of fluids into the formation 38. For example, after the holes 66 are formed in the formation 38, stimulation fluids are flowed through the work string 18 or the ported sub 46 of the tubing string 42 and into the openings 66. It is undesirable for these stimulation fluids to also flow into the previously-formed openings 56. The plug 60 and the fluid 32 filling the void 62 prevent such undesirable flow of the stimulation fluids.

When the stimulation fluids are flowed into the formation 38 through the openings 66, fractures 68 (see FIG. 6) may be formed extending transversely outward from the uncased portion 14. Note that, as with the previously described fractures 58, the stimulation fluids may be flowed through the work string 18 with the tubing string 42 withdrawn therefrom, the stimulation fluids may be flowed through the ports 52 of the ported sub 46, or may be otherwise flowed into the openings 66 without departing from the principles of the present invention.

Figure 6:
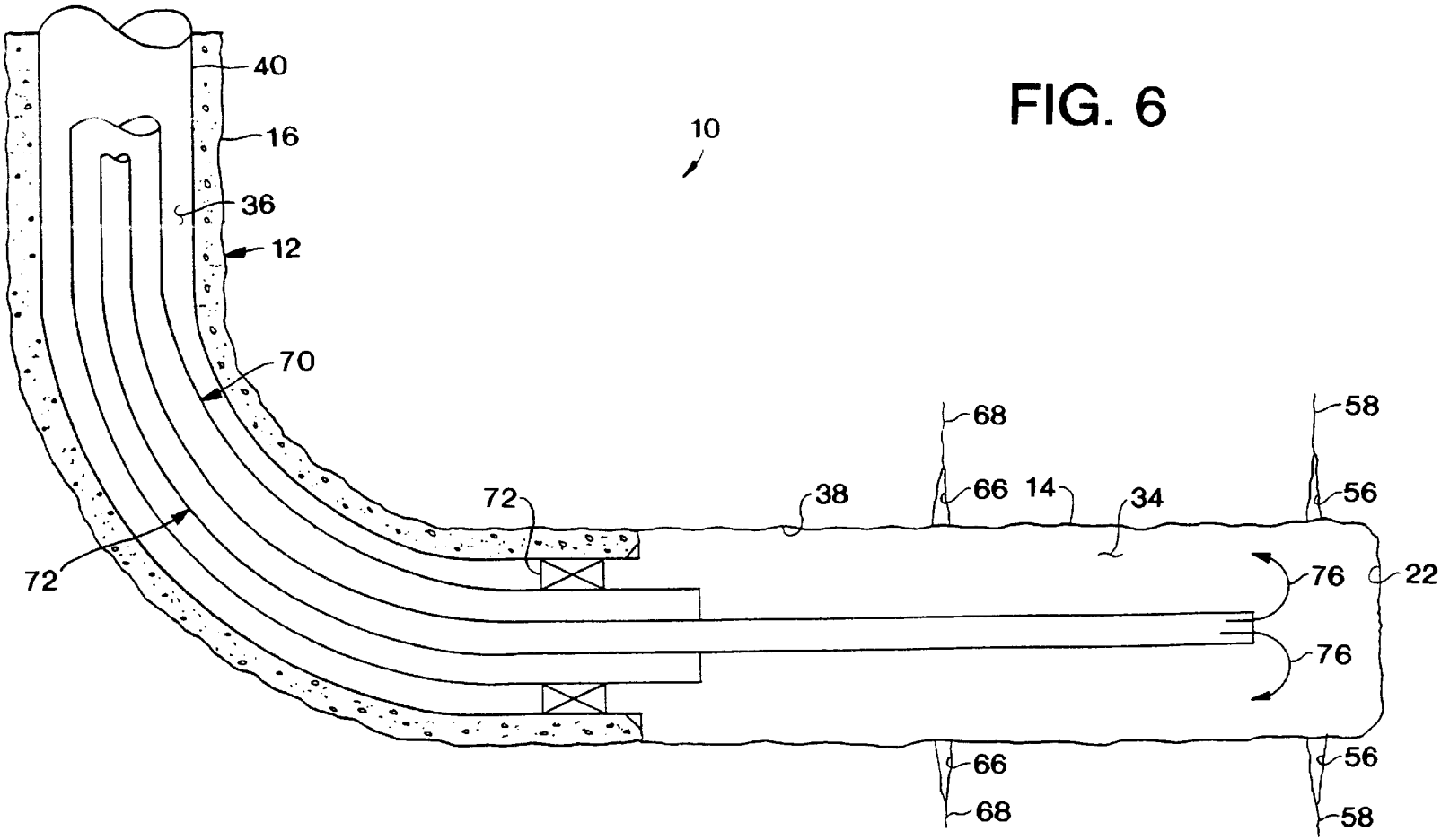
FIG. 6 is a cross-sectional view of the subterranean well of FIG. 1, showing production tubing operatively positioned within the well and the well being cleaned by flowing fluid through coiled tubing received in the production tubing, according to the first method.

Referring additionally now to FIG. 6, the well 12 is shown with a production tubing string 70 disposed therein. The production tubing string 70 may be inserted into the well 12 after the work string 18 is removed therefrom, or the work string 18 may be used as the production tubing string 70 without departing from the principles of the present invention. A coiled tubing string 72 is shown received within the production tubing string 70. The coiled tubing string 72 may be inserted into the production tubing string 70 after the tubing string 42 is removed from the well 12, or the tubing string 42 may be utilized as the coiled tubing string 72 without departing from the principles of the present invention.

As representatively illustrated in FIG. 6, the production tubing string 70 includes a production packer 74 which operates to isolate the annulus 36 from the uncased portion 38. In this manner, production fluids may be retrieved from the formation 38 via the production tubing 70 extending to the earth's surface, according to conventional practice. It is to be understood that, during normal subsequent production of fluids from the uncased portion 14, the coiled tubing 72 is preferably not disposed within the production tubing 70.

The coiled tubing 72 is shown extending into the uncased portion 14 near the end 22 thereof. A cleanup fluid, indicated by arrows 76 is flowed through the coiled tubing 72 from the earth's surface to remove the viscous fluid 32 from the uncased portion 14 prior to placing the well 12 into production. Where the fluid 32 is the preferred K-MAX™ or MAX SEAL™, a mild acidic solution may be used for the cleanup fluid 76. Preferably, such a mild acidic solution is approximately 3% acid. In this manner, the fluid 32 is removed from contact with the formation 38 and is flushed upwardly through the production tubing string 70.

Thus has been described the method 10 which permits multiple stimulation locations within the uncased portion 14 of the well 12. The method 10 permits such multiple stimulation locations without requiring the use of expensive and unreliable inflatable packers, and without requiring the uncased portion 14 to be cased and cemented.

Figure 7:
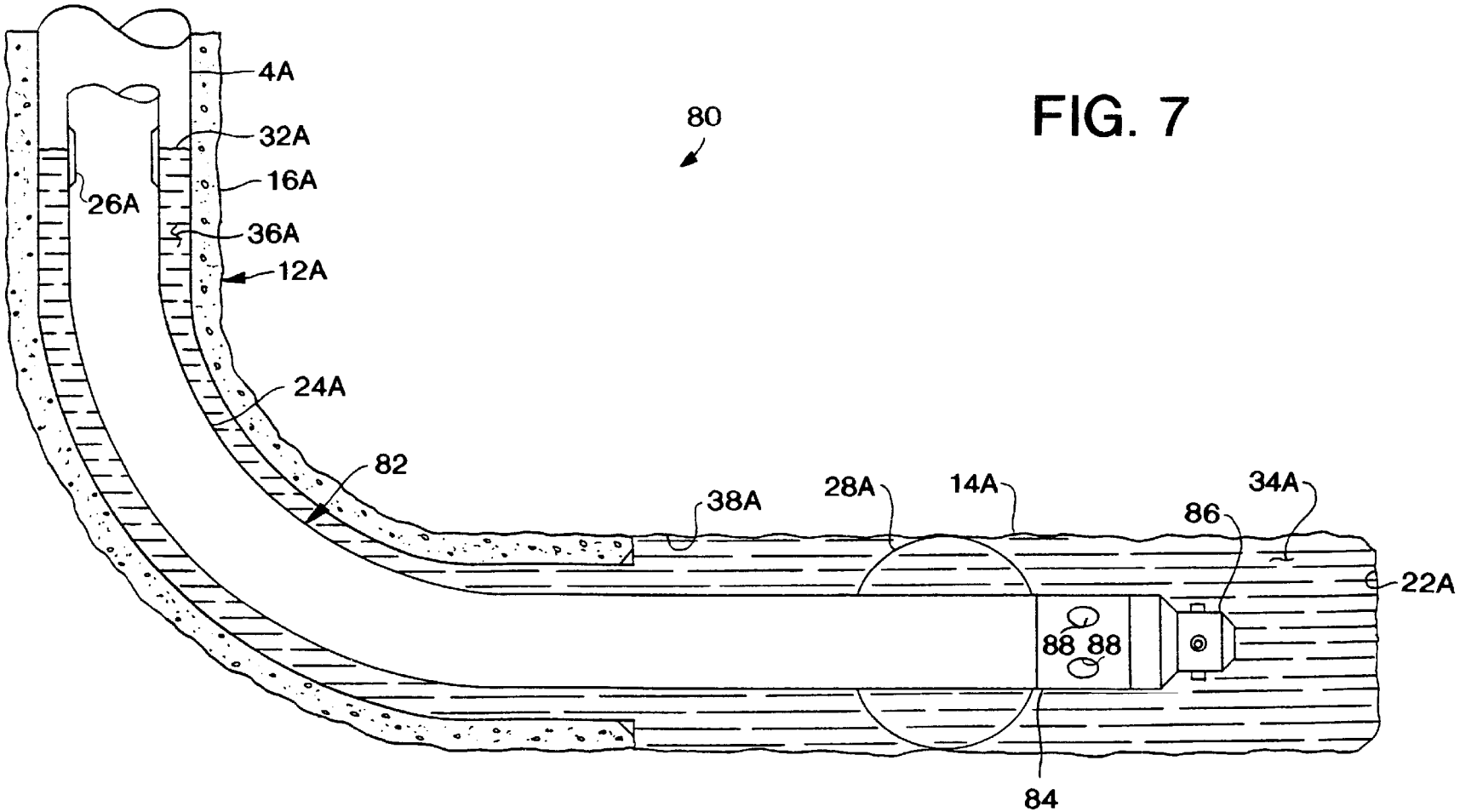
FIG. 7 is a cross-sectional view of a subterranean well, wherein a work string having a hydraulic jet cutter head attached thereto is operatively positioned within the well, according to a second method embodying principles of the present invention.

Turning now to FIG. 7, another method 80 embodying principles of the present invention is representatively illustrated. In the method 80 as shown in FIG. 7, elements thereof which are similar to previously described elements are indicated with the same reference numbers, with an added suffix "a". In substantial part, the method 80 differs from the method 10 in that a work string 82 is utilized in place of the separate work string 18 and tubing string 42.

The work string 82 includes the landing nipple 26*a,* tubing 24*a,* and centralizer 28*a*. Additionally, the work string 82 includes a ported sub 84 and a cutting head 86. The cutting head 86 is similar to the cutting head 50, and the ported sub 84 is similar to the ported sub 46 utilized in the method 10. However, the cutting head 86 and ported sub 84 are configured for attachment to the work string 82 which would in most cases be larger in diameter than the coiled tubing 44.

By running the cutting head 86 and ported sub 84 into the well 12*a* on the work string 82, separate operations for running and retrieving the tubing string 42 are eliminated. The cutting head 86 may be conveniently positioned relative to the uncased portion 14*a* of the well 12*a* at a desired stimulation location. Holes (such as holes 56 shown in FIG. 6) may then be cut into the formation 38*a* by the cutting head. Ports 88 on the ported sub 84 may then be opened to permit flow therethrough of stimulation fluids and a plug, such as plug 60, may be delivered through the ports.

The work string 82 may then be displaced axially relative to the formation to another stimulation location. The ports may be closed, and a plug, such as retrievable plug 64 may be operatively installed in the landing nipple 26*a*. The fluid 32 may be reconsolidated and any voids, such as void 62, filled by applying pressure to the annulus 36*a* (and the work string 82, if the retrievable plug is not installed in the landing nipple 26*a*).

The stimulation operation may be repeated a desired number of times, as with method 10, to produce a desired number of axially spaced apart stimulation locations in the uncased portion 14*a*. The work string 82 may then be withdrawn from the well 12*a* and replaced with a production tubing string, such as production tubing string 70 shown in FIG. 6. Alternatively, the work string 82 may be utilized as a production tubing string and cleanup fluid, such as fluid 76, may be circulated through the ports 88 to remove the viscous fluid 32*a*.

A benefit of the method 80 is that the larger diameter cutting head 86 may permit cutting of deeper holes into the formation 38*a,* since the cutting head is radially closer to the formation. An additional benefit is that the ports 88 may have larger flow area than the ports 52 of the ported sub 46. Yet another benefit of the method 80 is that there is no need to insert and remove the tubing string 42 into and from the work string 82. Still another benefit of the method 80 is that only one assembly, the work string 82, must be positioned relative to the uncased portion 14*a*.

Figure 8:
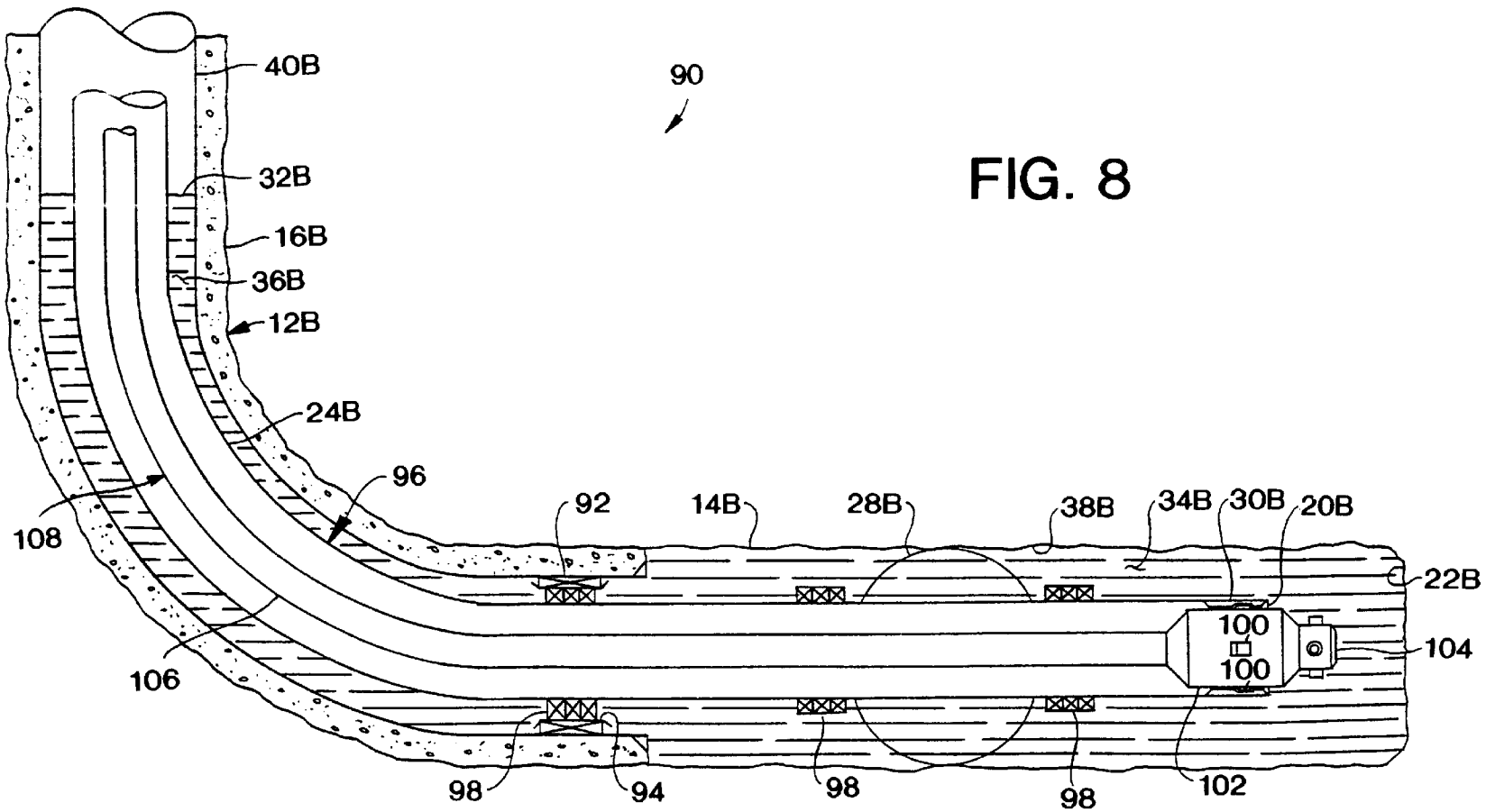
FIG. 8 is a cross-sectional view of a subterranean well, wherein a work string having a series of axially spaced apart seals disposed externally thereon is received in the well, and wherein a coiled tubing having a hydraulic jet cutter head attached thereto is operatively positioned within the work string, according to a third method embodying principles of the present invention.

Turning now to FIG. 8, a method 90 embodying principles of the present invention is representatively illustrated. Elements of the method 90 which are similar to elements previously described hereinabove are indicated using the same numbers, with an added suffix "b". In substantial part, the method 90 differs from the method 10 in that a packer 92 having an axially extending seal bore 94 formed therethrough is set in the casing 40*b,* and a work string 96 having an axially spaced apart series of seals 98 is positioned in the well 12*b,* such that the seals pass axially through and successively sealingly engage the seal bore 94. Note that, although the packer 92 is shown as having the seal bore 94 formed therethrough, it is to be understood that the seal bore may be otherwise connected to the packer, for example, by attaching a tubular member (not shown) having the seal bore formed therethrough to the packer.

The work string 96 includes the latching profile 30*b* proximate the end 20*b* thereof. As with the method 10, the latching profile 30*b* operatively engages latches 100 extending radially outward from a latching sub 102 attached axially between a cutting head 104 and coiled tubing 106 extending to the earth's surface. The cutting head 104, latching sub 102, and coiled tubing 106 are included in a tubing string 108 received within the work string 96.

Note that the tubing string 108 as representatively illustrated does not include a ported sub, such as ported sub 46 of the tubing string 42. In the method 90 shown in FIG. 8, stimulation fluids are conveyed to the uncased portion 14*b* of the well 12*b* via the work string 96 and, thus, a ported sub is not needed on the tubing string 108. It is to be understood, however, that a ported sub could be included in the tubing string 108, and stimulation fluids could be conveyed to the uncased portion 14*b* via the ported sub, without departing from the principles of the present invention.

In the method 90, the packer 92 is set in the casing 40*b* and the work string 96 is inserted therein. The fluid 32*b* is spotted in the uncased portion 14*b* and upwardly into the annulus 36*b* by, for example, flowing the fluid through the work string 96 from the earth's surface. During such spotting of the fluid 32*b,* preferably none of the seals 98 sealingly engage the seal bore 94.

After the fluid 32*b* has substantially filled the uncased portion 14*b* and extends upward sufficiently far into the annulus 36*b,* the work string 96 is axially displaced relative to the uncased portion 14*b* to position the cutting head 104 opposite a desired stimulation location and to position one of the sets of seals 98 in sealing engagement with the seal bore 94. Note that, if the tubing string 108 is not yet received within the work string 96, or if the latching sub 102 is not yet operatively engaged with the latching profile 30*b,* such positioning of the cutting head 104 opposite the desired stimulation location will comprise positioning the end 20*b* of the work string relative to the desired stimulation location, so that when the latching sub is subsequently operatively engaged with the latching profile 30*b,* the cutting head 104 will be properly positioned.

When the cutting head 104 is properly positioned relative to the desired stimulation location within the uncased portion 14*b,* holes (such as holes 56 shown in FIG. 6) are cut by the cutting head into the formation 38*b*. During the cutting operation, return circulation may be provided as described above for the method 10. The tubing string 108 is then withdrawn from the work string 96 and stimulation fluids are flowed through the work string and into the formation 38*b* via the holes. The sealing engagement of the seals 98 with the seal bore 94 prevents displacement of the fluid 32*b* further upward into the annulus 36*b* due to the pressure applied to the stimulation fluids to flow the fluids into the formation 38*b*.

When the stimulation fluids have been flowed sufficiently into the formation 38*b*, such as when the formation has been sufficiently fractured and suitable proppant delivered into the resulting fractures, a plug, such as plug 60, is delivered to the uncased portion 14*b* through the work string 96. As with the method 10, the plug may be "tailed-in" following the stimulation fluids, or may be separately conveyed through the work string. Alternatively, any voids left by the stimulation operation may be filled by any of the procedures described hereinabove, such as by applying pressure to the annulus 36*b* to flow a portion of the fluid 32*b* into the voids (after the seals 98 no longer sealingly engage the seal bore 94).

The work string 96 is then displaced axially relative to the uncased portion 14*b* so that the seals 98 no longer sealingly engage the seal bore 94. Pressure may then be applied to the annulus 36*b* from the earth's surface to flow the fluid 32*b* from the annulus 36*b* to any voids left by such displacement of the work string 96. A balancing pressure may also be applied to the work string 96 at the earth's surface to prevent flow of the fluid 32*b* into the work string.

To repeat the stimulation operation, another of the sets of seals 98 may then be sealingly engaged with the seal bore 94. The sets of seals 98 are axially spaced apart so that as each is successively sealingly engaged with the seal bore 94 prior to corresponding successive stimulation operations, the cutting head 104 is positioned opposite successive desired stimulation locations in the uncased portion 14*b*. Thus, the number of sets of seals 98 and the axial spacing therebetween corresponds to a desired number and axial spacing of stimulation locations.

After the desired stimulation operations have been performed, the work string 96 and the tubing string 108 are withdrawn from the well 12*b* and a production tubing string, such as production tubing string 70 shown in FIG. 6, is installed in the well. The well 12*b* is cleaned by, for example, inserting a coiled tubing, such as coiled tubing 72, into the production tubing string and flowing a cleanup fluid, such as mild acid or an enzyme solution, therethrough as described hereinabove for the method 10. Alternatively, the work string 96 may be utilized as the production tubing string and/or the tubing string 108 may be utilized as the coiled tubing for use in cleaning the fluid 32*b* from the well 12*b*.

Benefits derived from use of the method 90 include the fluid pressure and flow control afforded by the sealing engagement of the seals 98 with the seal bore 94. Especially during the stimulation operations, such sealing engagement is beneficial in preventing flow of the fluid 32*b* within the annulus 36*b*. Another benefit is that it is not necessary to maintain pressure on the annulus 36*b* during the stimulation operations to balance the pressure of the stimulation fluids flowed through the work string 96.

Figure 9:
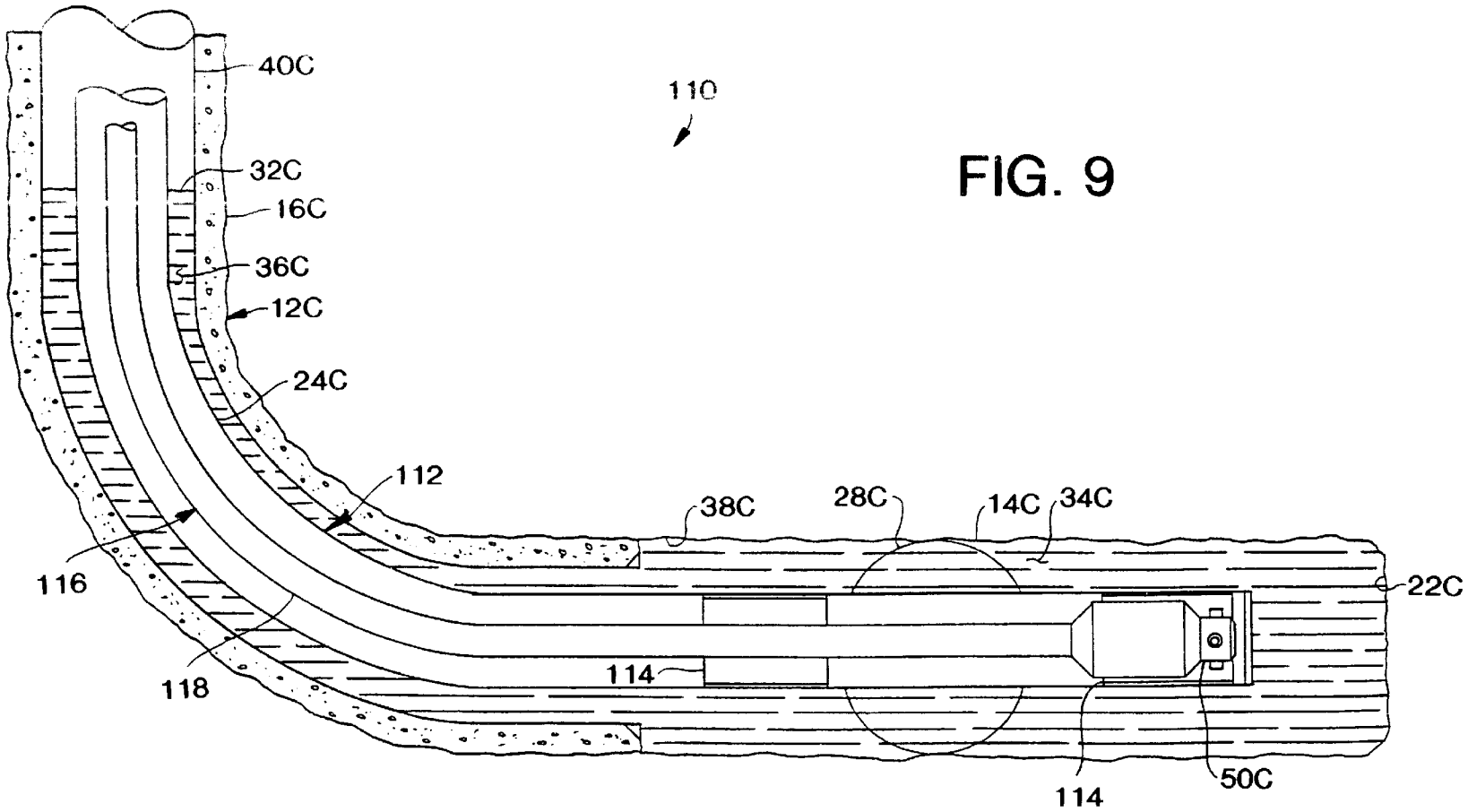
FIG. 9 is a cross-sectional view of a subterranean well, wherein a work string having a plurality of recloseable sliding sleeves is disposed within the well, and wherein a coiled tubing having a hydraulic jet cutter head attached thereto is operatively positioned within the work string, according to a fourth method embodying principles of the present invention.

Turning now to FIG. 9, a method 110 embodying principles of the present invention is representatively illustrated. Elements of the method 110 which are similar to previously described elements are indicated using the same reference numbers, with an added suffix "c". The method 110 differs from the method 10 in substantial part in that a work string 112 is not axially displaced relative to the uncased portion 14*c* between successive stimulation operations.

The work string 112 includes an axially spaced apart series of sliding sleeves 114 which are positioned in the work string opposite corresponding desired stimulation locations in the uncased portion 14*c*. The sliding sleeves 114 are conventional and are preferably of the type which may be alternately opened and closed to alternately permit or prevent radial flow therethrough. Such opening and closing of each of the sliding sleeves 114 may be accomplished by, for example, a shifting tool conveyed on a slickline, or by applying fluid pressure to the annulus 36*c* and/or the work string 112 at the earth's surface, as with the ported sub 46.

In the method 110, the fluid 32*c* is disposed within the uncased portion 14*c* by, for example, positioning the work string 112 in the uncased portion, opening one of the sliding sleeves 114, and flowing the fluid 32*c* therethrough, or, as another example, by spotting the fluid 32*c* in the uncased portion utilizing coiled tubing before the work string 112 is positioned therein. The work string 112 is positioned in the uncased portion 14*c* so that each of the sliding sleeves 114 is radially opposite a desired stimulation location.

A tubing string 116 is received in the work string 112. The tubing string 116 includes a coiled tubing 118 and a cutting head 50*c*. When it is desired to cut holes, such as holes 56, into the formation 38*c* at a desired stimulation location, the corresponding sliding sleeve 114 is opened and the cutting head 50*c* is operated to cut through the open sliding sleeve and into the formation. An alignment device (not shown) may be provided if desired to align the cutting head 50*c* with radially extending openings formed through the sliding sleeve 114. Additionally, a latching profile and latching sub, such as latching profile 30 and latching sub 48, may be provided to ensure positive axial alignment of the cutting head 50*c* with the sliding sleeve 114 at each desired stimulation location.

When the holes have been formed in the formation 38*c*, the tubing string 116 is withdrawn from the work string 112. Stimulation fluids are flowed from the earth's surface, through the work string, and outward through the open sliding sleeve 114. The stimulation fluids then enter the formation 38*c* via the holes cut by the cutting head 50*c*.

When the stimulation operation is completed, the open sliding sleeve 114 is closed and another one of the sliding sleeves 114 is opened. The tubing string 116 is again inserted into the work string 112 so that the cutting head 50*c* is aligned with the open sliding sleeve 114. The hole cutting and stimulating operations may then be repeated as needed to produce a desired number of stimulation locations in the uncased portion 14*c*.

The tubing string 116 and work string 112 may then be withdrawn from the well 12*c* and a production tubing string, such as production tubing string 70 shown in FIG. 6, may be installed therein, or the work string 112 may be utilized as a production tubing string. If the work string 112 is utilized as a production tubing string, one or more of the sliding sleeves 114 may remain open for production of fluid from the formation 38*c* therethrough. The fluid 32*c* may be cleaned from the well 12*c* using any of the previously described procedures, such as by circulating a mild acid solution through the uncased portion 14*c*.

Note that, in any of the above described cleanup procedures, if the fluid 32*c* is too dense to enable free circulation thereof, foamed fluid may be used in the cleanup procedure to achieve a lower effective density during circulation.

Figure 10:
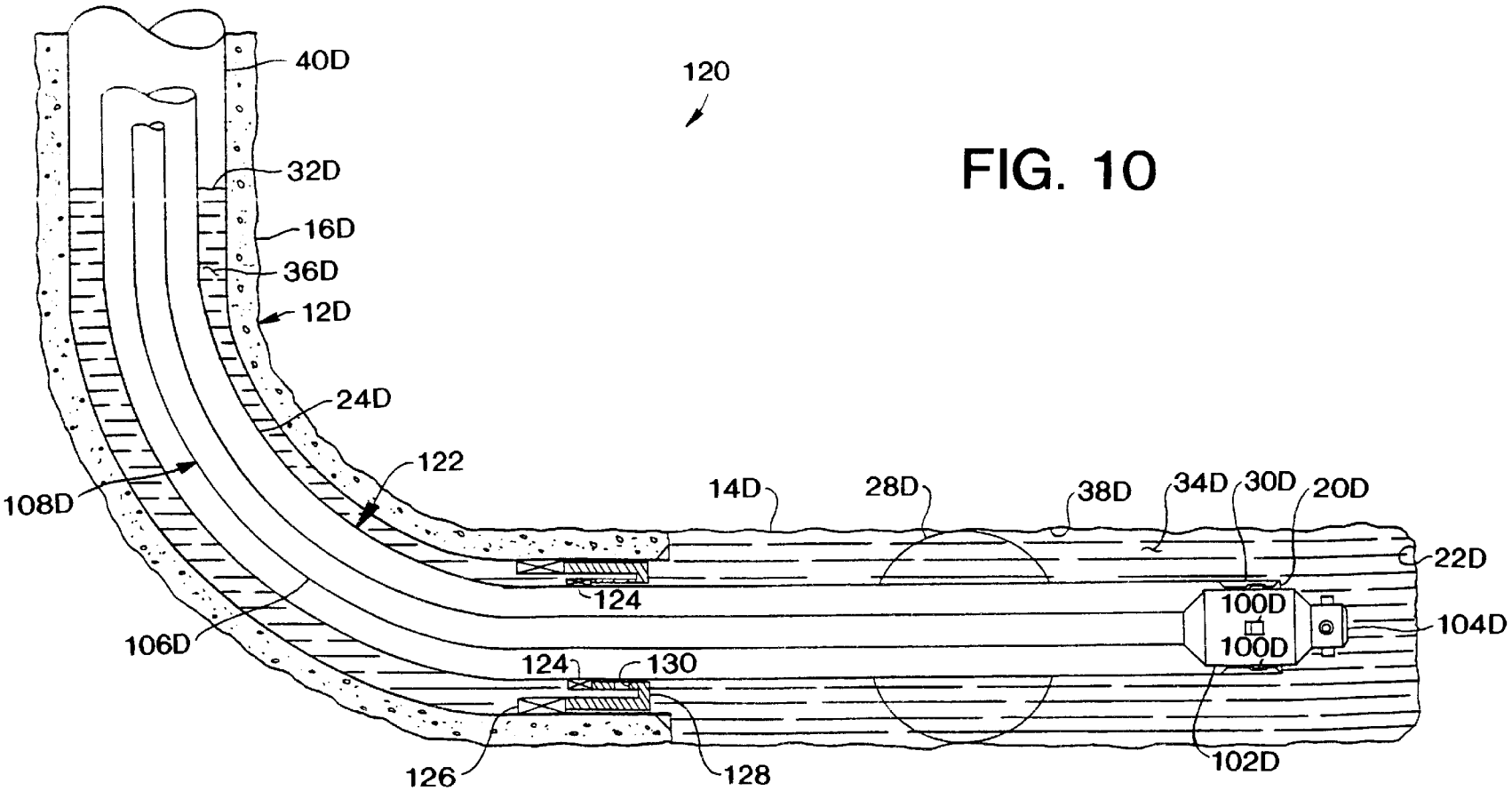
FIG. 10 is a cross-sectional view of a subterranean well, wherein a work string is received in the well, and wherein a coiled tubing having a hydraulic jet cutter head attached thereto is operatively positioned within the work string, according to a fifth method embodying principles of the present invention.

Turning now to FIG. 10, a method 120 embodying principles of the present invention is representatively illustrated. Elements of the method 120 which are similar to previously described elements are indicated using the same reference numbers, with an added suffix "d". The method 120 differs from the method 90 in substantial part in that a work string 122 is axially displaced relative to the uncased portion 14*d* between successive stimulation operations and is sealingly engaged by a set of seals 124 attached to a packer 126 set in the casing 40*d*.

The seals 124 may be of the type known to those skilled in the art as "stripper rubbers", "cup seals", or may be another type of seal capable of sealingly engaging the work string 122. Additionally, the seals 124 are preferably capable of sealingly engaging the work string 122 during axial displacement of the work string relative to the uncased portion 14*d*.

The seals 124 are attached to the packer 126 via a generally tubular mechanism 128. The mechanism 128 is preferably of the type known to those of ordinary skill in the art that is capable of releasing the seals 124 for retrieval of the seals to the earth's surface. Such release of the seals 124 may be accomplished by, for example, shifting a sleeve (not shown) within the mechanism 128, applying a predetermined pressure to the mechanism, etc. The mechanism 128 is also preferably of the type known to those of ordinary skill in the art that includes a recloseable bypass port 130. The bypass port 130 permits fluid communication between the annulus 36*d* and the annulus 34*d* when it is open. When closed, the bypass port 130 isolates the annulus 36*d* from the annulus 34*d*. Opening and closing of the bypass port 130 may be accomplished by, for example, shifting a sleeve (not shown) within the mechanism 128, applying a predetermined pressure to the mechanism, etc.

In the method 120, the packer 126 is set in the casing 40*d* and the work string 122 is inserted therein. The work string 122 is axially displaced relative to the uncased portion 14*d* to position the cutting head 104*d* opposite a desired stimulation location. Note that, if the tubing string 108*d* is not yet received within the work string 122, or if the latching sub 102*d* is not yet operatively engaged with the latching profile 30*d*, such positioning of the cutting head 104*d* opposite the desired stimulation location will comprise positioning the end 20*d* of the work string relative to the desired stimulation location, so that when the latching sub is subsequently operatively engaged with the latching profile 30*d*, the cutting head 104*d* will be properly positioned.

The fluid 32*d* is spotted in the uncased portion 14*d* and upwardly into the annulus 36*d* by, for example, flowing the fluid through the work string 122 from the earth's surface. During such spotting of the fluid 32*d*, preferably the bypass port 130 is open. After the fluid 32*d* has substantially filled the uncased portion 14*d*, it is preferably also flowed through the bypass port 130 and upward sufficiently far into the annulus 36*d*. The bypass port 130 is then closed.

When the cutting head 104*d* is properly positioned relative to the desired stimulation location within the uncased portion 14*d*, holes, such as holes 56, are cut by the cutting head into the formation 38*d*. The tubing string 108*d* is then withdrawn from the work string 122 and stimulation fluids are flowed through the work string and into the formation 38*d* via the holes. The sealing engagement of the seals 124 with the work string 122 prevents displacement of the fluid 32*d* further upward into the annulus 36*d* due to the pressure applied to the stimulation fluids to flow the fluids into the formation 38*d*.

When the stimulation fluids have been flowed sufficiently into the formation 38*d*, such as when the formation has been sufficiently fractured and suitable proppant delivered into the resulting fractures, a plug, such as plug 60, is delivered to the uncased portion 14*d* through the work string 122. As with the method 10, the plug may be "tailed-in" following the stimulation fluids, or may be separately conveyed through the work string. Alternatively, any voids left by the stimulation operation may be filled by any of the procedures described hereinabove, such as by opening the bypass port 130 and applying pressure to the annulus 36*d* to flow a portion of the fluid 32*d* into the voids.

The work string 122 is then displaced axially relative to the uncased portion 14*d* after opening the bypass port 130. Pressure may then be applied to the annulus 36*d* from the earth's surface to flow the fluid 32*d* from the annulus 36*d*, through the bypass port 130, to any voids left by such displacement of the work string 122. A balancing pressure may also be applied to the work string 122 at the earth's surface to prevent flow of the fluid 32*d* into the work string.

To repeat the stimulation operation, the bypass port 130 is closed and the above procedure is repeated, the cutting head 104*d* being positioned opposite another desired stimulation location to form holes in the formation 38*d* and form openings through the fluid 34*d*.

After the desired stimulation operations have been performed, the work string 122 and the tubing string 108*d* are withdrawn from the well 12*d* and a production tubing string, such as production tubing string 70 shown in FIG. 6, is installed in the well. The well 12*d* is cleaned by, for example, inserting a coiled tubing, such as coiled tubing 72, into the production tubing string and flowing a cleanup fluid, such as mild acid or an enzyme solution, therethrough as described hereinabove for the method 10. Alternatively, the work string 122 may be utilized as the production tubing string and/or the tubing string 108*d* may be utilized as the coiled tubing for use in cleaning the fluid 32*d* from the well 12*d*.

Figure 11:
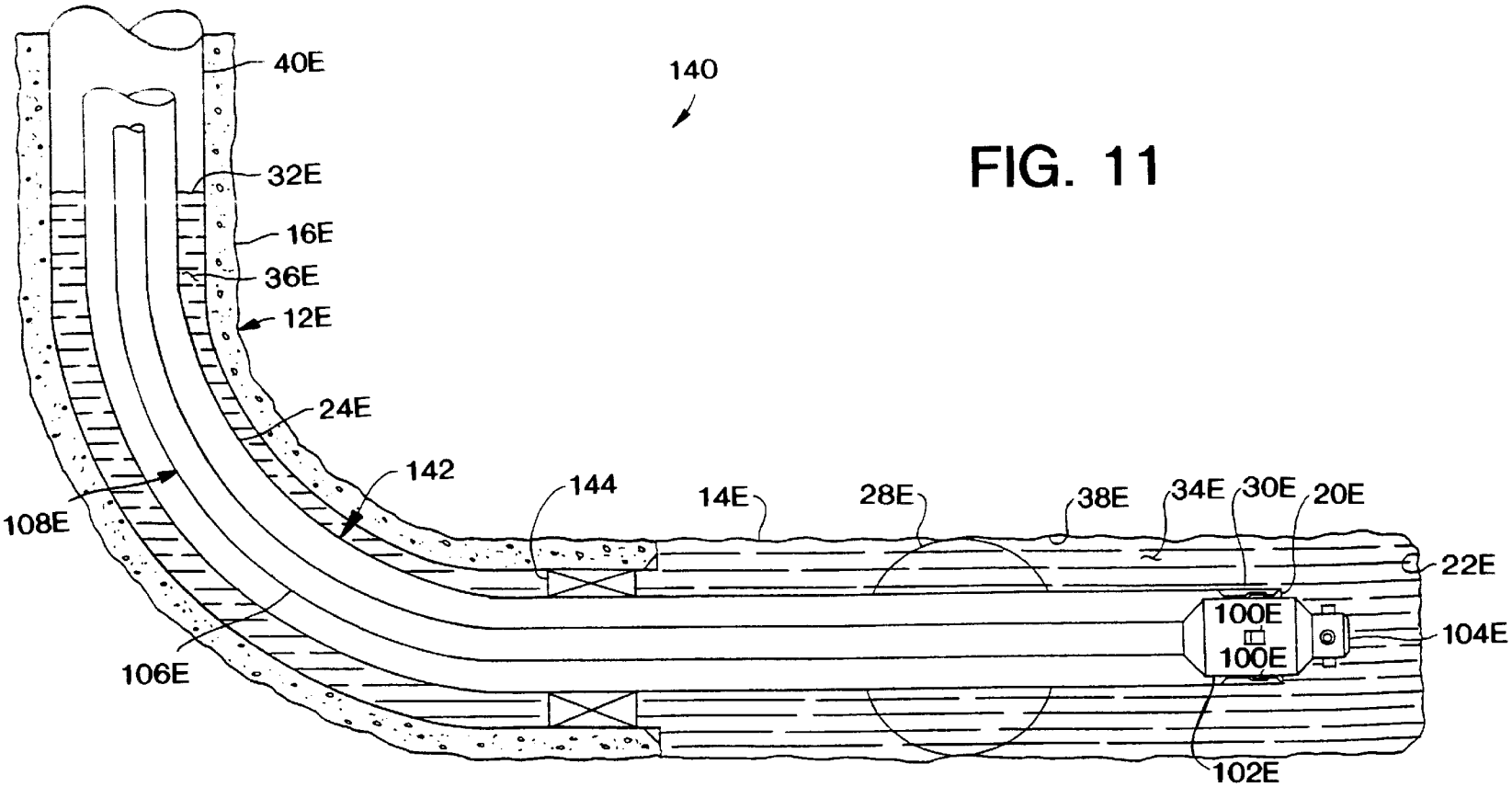
FIG. 11 is a cross-sectional view of a subterranean well, wherein a work string is received in the well, and wherein a coiled tubing having a hydraulic jet cutter head attached thereto is operatively positioned within the work string, according to a sixth method embodying principles of the present invention.

Turning now to FIG. 11, a method 140 embodying principles of the present invention is representatively illustrated. Elements of the method 140 which are similar to previously described elements are indicated using the same reference numbers, with an added suffix "e". The method 140 differs from the method 90 in substantial part in that a work string 142 is axially displaced relative to the uncased portion 14*e* between successive stimulation operations and a packer 144 attached to the work string is set in the casing 40*e* during stimulation operations and is unset during axial displacement of the work string.

The packer 144 is preferably of the type well known to those of ordinary skill in the art that is capable of being set and unset repeatedly within the subterranean well 12*e*. When set, the packer 144 isolates the annulus 36*e* from the annulus 34*e* and substantially fixes the axial position of the work string 142 relative to the casing 40*e*. When the packer 144 is unset, fluid communication is permitted between the annulus 36*e* and the annulus 34*e*, and the work string 142 may be axially displaced relative to the casing 40*e*. The packer 144 may be set and unset by, for example, manipulation of the work string 142 at the earth's surface.

In the method 140, the packer 144 is conveyed into the well 12*e* attached to the work string 142. The work string 142 is axially displaced relative to the uncased portion 14*e* to position the cutting head 104*e* opposite a desired stimulation location. Note that, if the tubing string 108*e* is not yet received within the work string 142, or if the latching sub 102*e* is not yet operatively engaged with the latching profile 30*e*, such positioning of the cutting head 104*e* opposite the desired stimulation location will comprise positioning the end 20*e* of the work string relative to the desired stimulation location, so that when the latching sub is subsequently operatively engaged with the latching profile 30*e*, the cutting head 104*e* will be properly positioned.

The fluid 32*e* is spotted in the uncased portion 14*e* and upwardly into the annulus 36*e* by, for example, flowing the fluid through the work string 142 from the earth's surface. During such spotting of the fluid 32*e,* preferably the packer 144 remains unset. After the fluid 32*e* has substantially filled the uncased portion 14*e* and extends upward sufficiently far into the annulus 36*e,* the packer 144 is set in the casing 40*e.*

When the cutting head 104*e* is properly positioned relative to the desired stimulation location within the uncased portion 14*e,* holes, such as holes 56, are cut by the cutting head into the formation 38*e.* The tubing string 108*e* is then withdrawn from the work string 142 and stimulation fluids are flowed through the work string and into the formation 38*e* via the holes. The sealing engagement of the packer 144 with the casing 40*e* prevents displacement of the fluid 32*e* further upward into the annulus 36*e* due to the pressure applied to the stimulation fluids to flow the fluids into the formation 38*e.*

When the stimulation fluids have been flowed sufficiently into the formation 38*e,* such as when the formation has been sufficiently fractured and suitable proppant delivered into the resulting fractures, a plug, such as plug 60, is delivered to the uncased portion 14*e* through the work string 142. As with the method 10, the plug may be "tailed-in" following the stimulation fluids, or may be separately conveyed through the work string. Alternatively, any voids left by the stimulation operation may be filled by any of the procedures described hereinabove, such as by unsetting the packer 144 and applying pressure to the annulus 36*e* to flow a portion of the fluid 32*e* into the voids.

The work string 142 is then displaced axially relative to the uncased portion 14*e* to a position corresponding to another desired stimulation location after the packer 144 is unset. Pressure may then be applied to the annulus 36*e* from the earth's surface to flow the fluid 32*e* from the annulus 36*e* to any voids left by such displacement of the work string 142. A balancing pressure may also be applied to the work string 142 at the earth's surface to prevent flow of the fluid 32*e* into the work string.

To repeat the stimulation operation, the packer 144 may again be set in the casing 40*e,* the tubing string 108*e* may be inserted into the work string 142 and withdrawn therefrom, and stimulation fluids may be flowed into the formation 38*e* at the next desired stimulation location.

After the desired stimulation operations have been performed, the work string 142 and the tubing string 108*e* are withdrawn from the well 12*e* and a production tubing string, such as production tubing string 70 shown in FIG. 6, is installed in the well. The well 12*e* is cleaned by, for example, inserting a coiled tubing, such as coiled tubing 72, into the production tubing string and flowing a cleanup fluid, such as mild acid or an enzyme solution, therethrough as described hereinabove for the method 10. Alternatively, the work string 142 may be utilized as the production tubing string and/or the tubing string 108*e* may be utilized as the coiled tubing for use in cleaning the fluid 32*e* from the well 12*e.*

Turning now to FIGS. 12A–12D, a method 150 embodying principles of the present invention is representatively illustrated. Elements of the method 150 which are similar to previously described elements are indicated in FIGS. 12A–12D using the same reference numbers, with an added suffix "f". The method 150 differs in substantial part from the previously described methods in that multiple stimulation locations within the well 12 may be treated successively without the need to remove a tubing string 152 from the well and without the need of a separate work string.

As described herein, the method 150 is utilized in a stimulation operation wherein the formation 38*f* is acidized or acid-fraced. However, it is to be understood that a method similar to the method 150 may be performed according to the principles of the present invention wherein the formation 38*f* is fractured and not acidized. Thus, other types of stimulation operations may be performed without departing from the principles of the present invention.

The formation 38*f* (or interval of the formation) contains multiple desired stimulation locations 154. As representatively illustrated in FIGS. 12A–12D, these locations 154 contain naturally occurring fractures 156 in the formation 38*f.* In the method 150 as described herein, it is desired to inject acid into the formation 38*f* at the locations 154, so that the acid will enter and enlarge the fractures 156 and permit subsequent enhanced injection of fluids, such as water, into the formation. It is to be clearly understood, however, that it is not necessary in a method performed in accordance with the principles of the present invention, for the formation 38*f* to include more than one desired stimulation location 154, for the locations to include the fractures 156, or for the stimulation operation to include injecting acid into the formation.

Figure 12A:
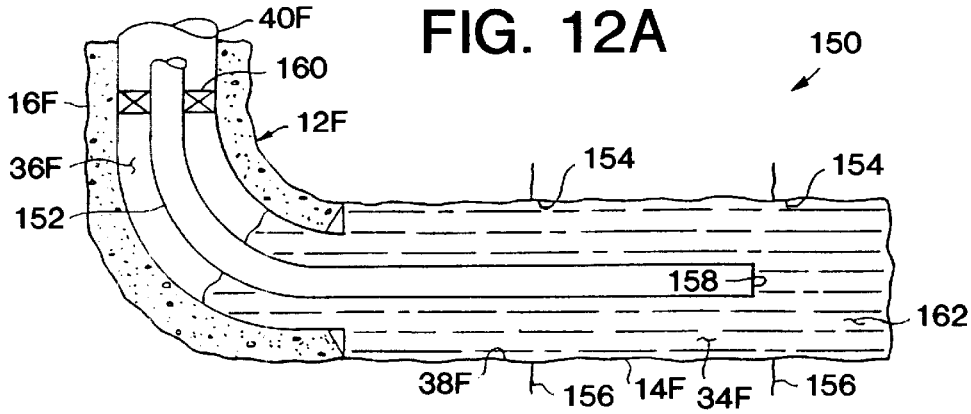
FIGS. 12A–12D are cross-sectional views of a subterranean well, wherein a tubing string is received in the well and a stimulation operation is performed according to a seventh method embodying principles of the present invention.

In FIG. 12A, it may be seen that the tubing string 152 has been positioned within the well 12*f,* with a lower end 158 of the tubing string disposed within the uncased portion 14*f* of the well. A packer 160 carried on the tubing string 152 is positioned within the cased portion 16*f* of the well 12*f.* The end 158 of the tubing string 152 is positioned opposite one of the desired stimulation locations 154. In the method 150, stimulation fluid is flowed through the end 158 of the tubing string 152, but the tubing string may also be provided with a cutting head, jet sub, or other fluid delivery device, in which case the fluid delivery device, instead of the tubing string end 158, is preferably positioned opposite one of the desired stimulation locations 154. The tubing string 152 may also be provided with one or more centralizers, such as the centralizers 28 shown in FIG. 1.

With the tubing string 152 positioned as shown in FIG. 12A, a barrier fluid 162 is circulated down the tubing string from the earth's surface and into the uncased portion 14*f* of the well 12*f.* Note that it is not necessary for the entire uncased portion 14*f* to be filled with the fluid 162, and some of the fluid may extend into the cased portion 16*f* of the well. It is preferred, however, that the fluid 162 contact the formation 38*f* at and between the desired stimulation locations 154 and generally fill the annulus 34*f* formed radially between the tubing string 152 and the formation. In this manner, stimulation fluid may be flowed from the tubing string 152 to each of the desired stimulation locations 154 in succession, while isolating the others of the stimulation locations from such flow, as will be more fully described hereinbelow.

The barrier fluid in the method 150 is preferably of the type which is not quickly dispersed by acid. Examples of acceptable fluids include Ma-Trol™, WG-11™ or WG-17™, available from Halliburton Energy Services, polymer gels, fluids known to those skilled in the art as HEC's, guar, acrylic gels, etc. Some of these fluids may be circulated into the well 12*f* and subsequently become more viscous, more gelatinous, or more rigid, or otherwise "set" within the well. No matter the fluid 162 utilized, it is preferred that it be substantially incapable of flowing significantly into the formation 38*f,* and that it be capable of isolating the stimulation locations 154 from each other. For example, an HEC fluid deposited in an annulus over an interval of approximately 1,000 feet and permitted to set therein is capable of withstanding a pressure differential of approximately 1,500 psi and, thus, forms a "chemical packer" in the annulus which may serve to isolate one stimulation location from another.

The packer 160 is set in the cased portion 16*f* of the well 12*f*. The packer 160 anchors the tubing string 152 within the well 12*f* and seals off the annulus 36*f*. The method 150 may be performed with the packer 160 being set either before or after the barrier fluid 162 is deposited in the well 12*f*. For example, the fluid 162 may be circulated into the uncased well portion 14*f* before the packer 160 is set, or the fluid may be circulated into the well 12*f* after the packer is set, but while a bypass port of the packer is open. It is to be understood that it is not necessary for the packer 160 to be provided in the method 150, since the fluid 162 may also serve to isolate the uncased portion 14*f* of the well 12*f*. Thus, the fluid 162 may serve as a "chemical packer" in place of the packer 160. However, use of the packer 160 is preferred in the method 150 to anchor the tubing string 152 within the cased portion 16*f* of the well 12*f*.

Figure 12B:
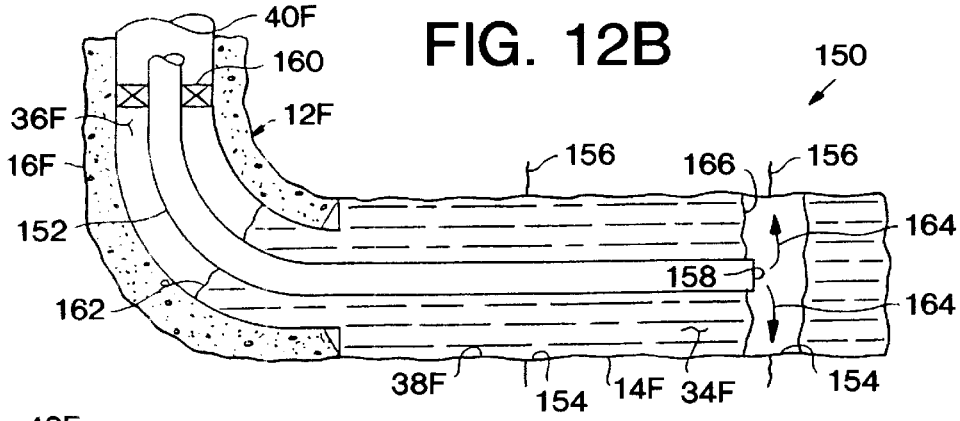

As representatively illustrated in FIG. 12B, stimulation fluid (indicated by arrows 164 is flowed from the earth's surface, through the tubing string 152, and into one of the desired stimulation locations 154 of the formation 38*f*. In doing so, the stimulation fluid 164 forms a passageway or opening 166 extending from the tubing string 152 to the stimulation location 154. During this flowing of the stimulation fluid 164, the barrier fluid 162 prevents the stimulation fluid from entering any other portion of the formation 38*f*, or any other formation intersected by the well 12*f*.

Figure 12C:
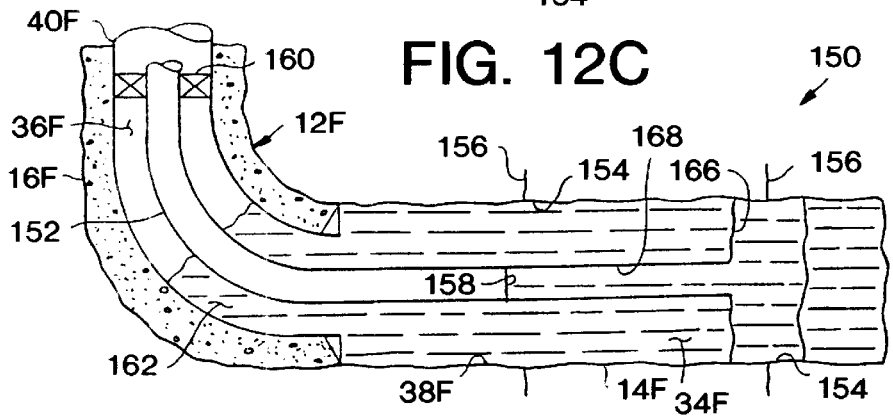

As representatively illustrated in FIG. 12C, when the treatment of the first stimulation location 154 is completed, the packer 160 is unset and the tubing string 152 is repositioned so that the tubing string end (or other fluid delivery device) is disposed opposite another one of the desired stimulation locations. In repositioning the tubing string 152, a void 168 may be created extending from the end 158 of the tubing string to the opening 166. This void 168, if any, and the opening 166 are then filled with additional barrier fluid 162. The opening 166 and void 168 are shown in FIG. 12C filled with the barrier fluid 162. This additional barrier fluid 162 may be circulated from the earth's surface through the tubing string 152 into the void 168 and opening 166, may be displaced thereinto from the annulus 34*f* or 36*f* by applying fluid pressure to the annulus 36*f*, and may have filler or granular material, such as sand, mixed therewith.

Figure 12D:
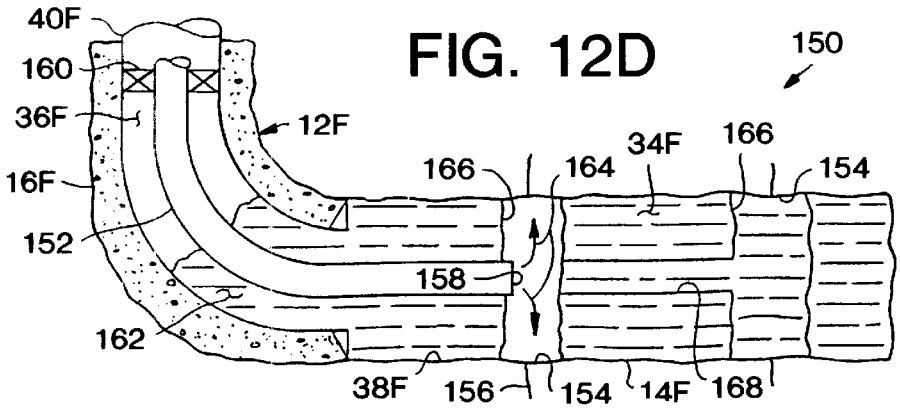

As representatively illustrated in FIG. 12D, the packer 160 is set and further stimulation fluid 164 is then flowed from the earth's surface through the tubing string 152 and into another desired stimulation location 154. The additional barrier fluid 162 which was previously flowed into the opening 166 and void 168 prevents the stimulation fluid 164 from flowing to the previously treated stimulation location. The stimulation fluid 164 flowing from the tubing string 152 to the stimulation location 154 creates another opening 166 through the barrier fluid 162.

It will be readily appreciated by one of ordinary skill in the art that the tubing string 152 may be positioned at any number of stimulation locations 154 in the well 12*f* to thereby permit the stimulation locations to be individually treated in succession. The barrier fluid 162 prevents the stimulation fluid 164 from entering different portions of the formation 38*f*, or other formations and, in addition, permits the openings 166 and any voids 168 to be isolated from each other. In this manner, the barrier fluid 162 may act both as a "chemical packer" and as a "chemical plug".

Figure 13A:
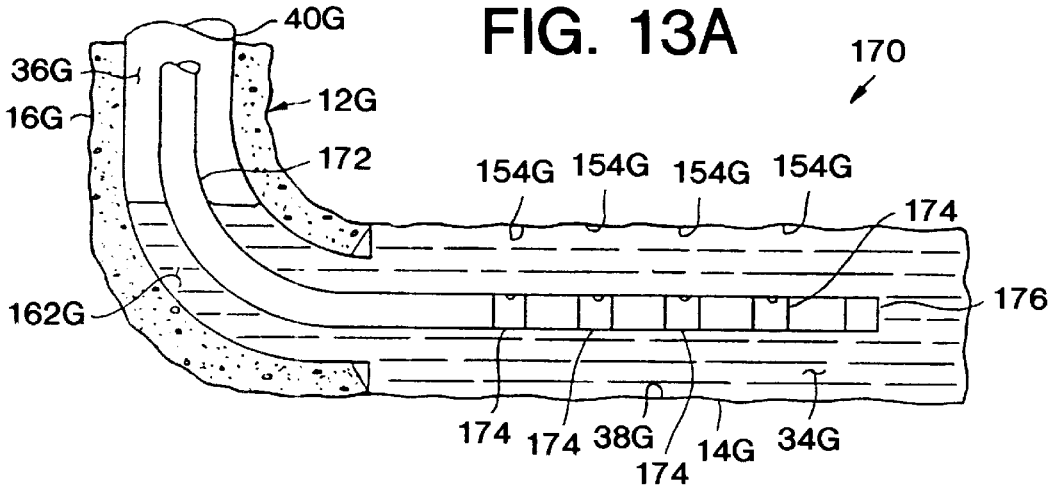
FIGS. 13A–13C are cross-sectional views of a subterranean well, wherein a tubing string including jet subs is received in the well and a stimulation is performed according to an eighth method embodying principles of the present invention.
Figure 13B:
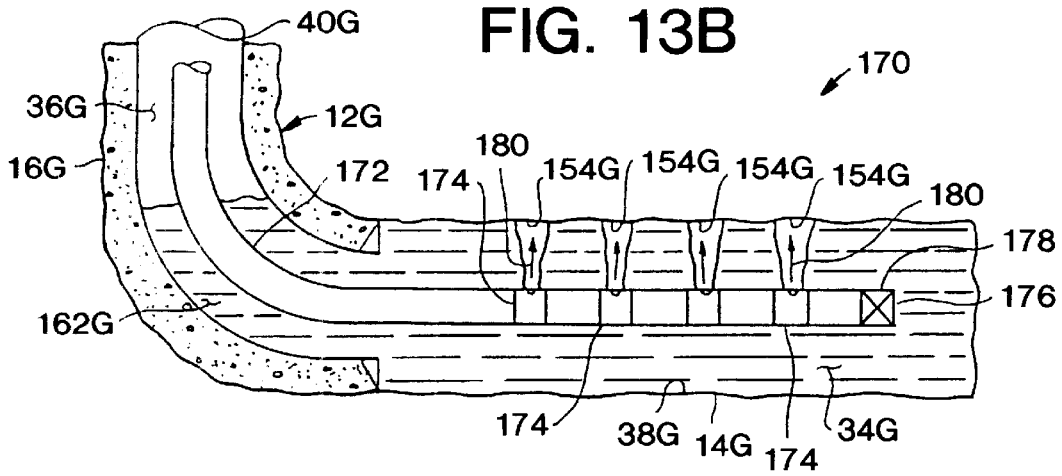
Figure 13C:
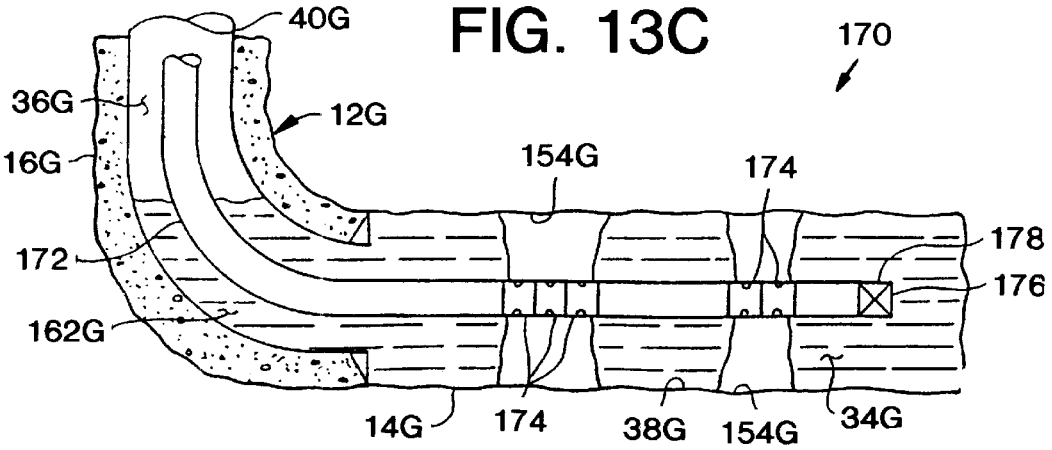

Referring additionally now to FIGS. 13A–13C, another method 170 embodying principles of the present invention is representatively illustrated. Elements of the method 170 which are similar to previously described elements are indicated in FIGS. 13A–13C using the same reference numbers, with an added suffix "g". The method 170 differs from the previously described methods in substantial part in that the method permits multiple desired stimulation locations 154*g* to be treated simultaneously while the barrier fluid 162*g* isolates each stimulation location from the other stimulation locations and from the remainder of the formation 38*g* and any other formation or portion of a formation.

In FIG. 13A it may be seen that a tubing string 172 is positioned within the well 12*g* and extends into the uncased well portion 14*g*. The tubing string 172 includes a series of axially spaced apart cutting heads or jet subs 174, or other fluid delivery devices, interconnected therein. When the tubing string 172 is appropriately positioned in the well 12*g*, each of the jet subs 174 is disposed opposite a corresponding one of the desired stimulation locations 154*g*.

The barrier fluid 162*g* is deposited within the uncased well portion 14*g* and preferably fills a substantial part of the annulus 34*g*. The barrier fluid 162*g* may also extend into the cased portion 16*g* of the well 12*g*. Preferably, the barrier fluid 162*g* is deposited in the uncased well portion 14*g* by circulating it from the earth's surface through the tubing string 172 and outward through a landing nipple 176 or other receptacle connected to a lower end of the tubing string. As shown in FIG. 13A, the landing nipple 176 is open to fluid flow axially therethrough.

Note that the tubing string 172 may or may not have a packer (not shown) interconnected therein for setting within the cased well portion 16*g*. In the method 170 as shown in FIGS. 13A–13C, the barrier fluid 162 provides isolation between the annulus 34*g* and the annulus 36*g*. The tubing string 172 may also include one or more centralizers, such as centralizers 28 shown in FIG. 1.

As representatively illustrated in FIG. 13B, a plug 178 has been installed in the landing nipple 176 to close off the end of the tubing string 172. The plug 178 may be conveyed into the tubing string 172 by any of a variety of means, such as by coiled tubing, etc. Preferably, the plug 178 is inserted into the tubing string 172 just after the barrier fluid 162*g*, so that after the fluid has been deposited in the uncased well portion 14*g*, the plug will be circulated into sealing engagement with the landing nipple 176. It is to be clearly understood that the barrier fluid 162*g* may be otherwise deposited in the uncased well portion 14*g*, and the tubing string 172 may be otherwise closed to fluid flow therethrough (or not closed at all if the end of the tubing string or other fluid delivery device is disposed opposite one of the desired stimulation locations), without departing from the principles of the present invention.

Stimulation fluid (indicated by arrows 180) is flowed from the earth's surface, through the tubing string 172, through each of the jet subs 174, and into each of the desired stimulation locations 154*g* simultaneously. Thus, all of the stimulation locations 154*g* are treated at one time, without the need to reposition the tubing string 172. Of course, the tubing string 172 may be repositioned if desired, for example, to treat additional stimulation locations (not shown) intersected by the uncased well portion 14*g*.

Representatively illustrated in FIG. 13C is a variation of the method 170 wherein jet subs 174, or other fluid delivery devices, are grouped together at various stimulation locations 154*g*, to produce a desired flow rate, fluid delivery pressure, etc. at each stimulation location. For example, it may be desired to flow the stimulation fluid 180 at one flow rate at one stimulation location 154*g*, but at another flow rate at another stimulation location. Other means of accomplishing this result may be utilized without departing from the principles of the present invention. For example, one jet sub 174 positioned at one stimulation location 154*g* may have a larger or smaller diameter orifice, or a greater or smaller number of such orifices, for flow therethrough than another jet sub positioned at another stimulation location. One or more of the jet subs 174 may also have multiple fluid passages or orifices for delivery of stimulation fluid to a respective one of the stimulation locations 154*g*.

Figure 14:
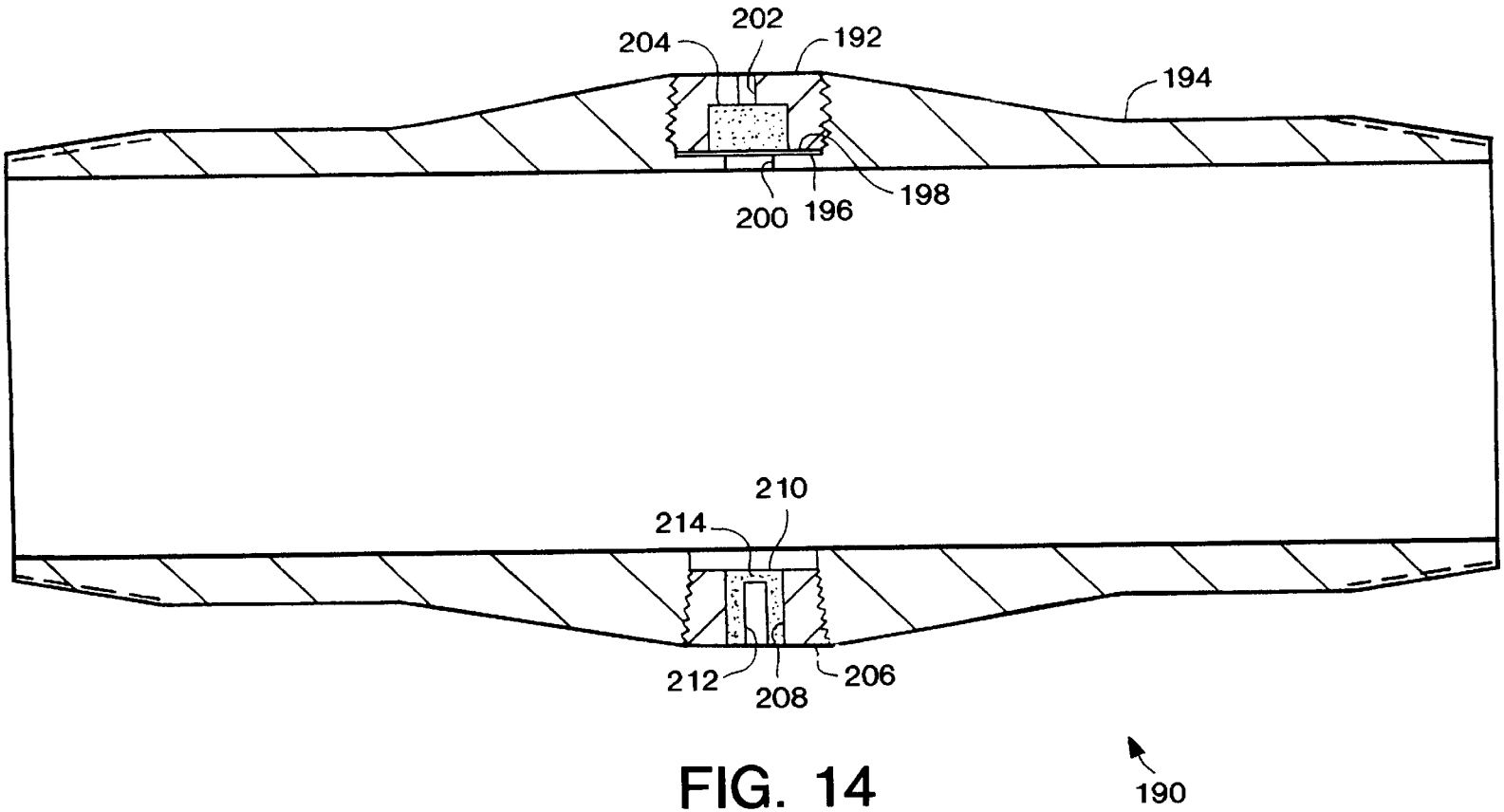
FIG. 14 is a cross-sectional view of a first jet sub embodying principles of the present invention.

Referring additionally now to FIG. 14, a fluid delivery device or jet sub 190 embodying principles of the present invention is representatively illustrated. The jet sub 190 is usable in the methods 150, 170 described hereinabove, and may be used in other methods without departing from the principles of the present invention. The jet sub 190 is depicted in FIG. 14 having two types of orifice configurations, in order to demonstrate that a variety of orifice configurations are encompassed by the principles of the present invention and that multiple orifices may be utilized in a single jet sub, but it is to be understood that different numbers of orifices and differently configured orifices may be utilized without departing from the principles of the present invention.

The jet sub 190 includes a generally tubular housing 194, which is provided with appropriately configured ends for interconnection into a tubing string, such as tubing strings 152, 172. An orifice member 192 is threadedly installed into an enlarged sidewall portion of the housing 194. The orifice member 192 is sealingly engaged with the housing 194 via a flat washer 196 positioned between the orifice member and an internal shoulder 198 formed on the housing.

An opening 200 is formed radially through the housing 194. An orifice 202 is formed axially through the orifice member 192. The orifice 202 may be sized to permit a desired flow rate therethrough at a particular differential pressure, and the opening 200 is preferably sized to permit the greatest desired flow rate therethrough that is reasonably to be expected in use of the jet sub 190.

Fluid communication between the opening 200 and the orifice 202 is blocked by an orifice plugging member 204. In the representatively illustrated embodiment, the plugging member 204 is made of an acid soluble material, such as acid soluble cement, for use of the jet sub 190 in a method wherein the stimulation fluid is acidic. In this manner, the jet sub 190 preferably does not permit delivery of fluid to its respective desired stimulation location until the barrier fluid has been deposited in the well and the stimulation fluid has been circulated to the interior of the jet sub.

Thus, for example, in the method 170, the barrier fluid 162*g* may be circulated through the tubing string 172 and out into the annulus 34*g* while the plugging members 204 prevent the barrier fluid from passing through the orifices 202. Thereafter, stimulation fluid 180 may be delivered into the tubing string after the plug 178, so that as the plug seals within the nipple 176, the stimulation fluid is delivered to the interior of the jet subs 190. If the stimulation fluid 180 is acidic and the plugging members 204 are acid soluble, eventually the plugging members will dissolve and permit flow of the stimulation fluid through the orifices 202 of the jet subs 190. The stimulation fluid 180 may then be flowed simultaneously into the desired stimulation locations 154*g*.

It is to be clearly understood that the plugging members 204 may be constructed of numerous different materials that may be otherwise dissolved or dispensed with, such as by aromatic hydrocarbons, alcohols or other chemicals or agents, without departing from the principles of the present invention. Additionally, the orifice 202 and orifice member 192 may be otherwise configured, may be otherwise attached to the housing 194 and may be integrally formed with the housing, without departing from the principles of the present invention.

Another orifice member 206 is threadedly installed radially into the housing 194 opposite the previously described orifice member 192. The orifice member 206 is provided with tapered sealing threads, and so no separate seal member, such as the washer 196, is required. The orifice member 206 has an orifice 208 formed axially therethrough.

Fluid flow through the orifice 208 is blocked by a plugging member 210. The plugging member 210 in the representatively illustrated jet sub 190 is made of acid soluble cement, which is either molded in place within the orifice member 206, or separately formed and then sealingly attached to the orifice member. As with the previously described plugging member 204, the plugging member 210 may be otherwise formed and may be made of different materials without departing from the principles of the present invention.

The plugging member 210 has an external cavity 212 formed therein, leaving a relatively thin closure 214 facing inwardly toward the interior of the housing 194. When stimulation fluid is delivered to the interior of the jet sub 190, the closure 214 is relatively quickly dissolved, thereby permitting the stimulation fluid to enter the cavity 212, and exposing more surface area of the plugging member 210 to the stimulation fluid. Thus, the unique design of the plugging member 210 reduces the amount of time needed to open the orifice 208 to fluid flow therethrough.

Figure 15:
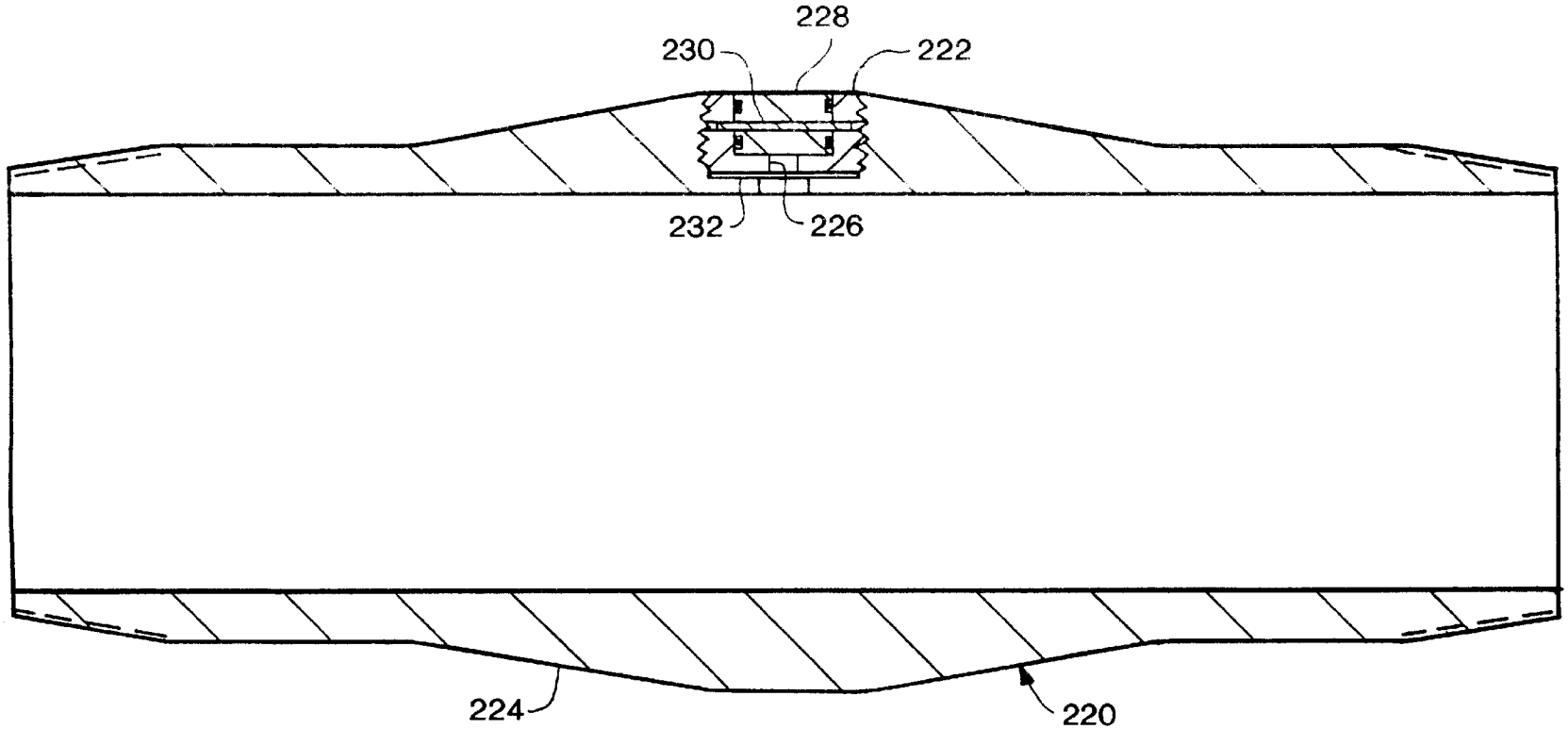
FIG. 15 is a cross-sectional view of a second jet sub embodying principles of the present invention.

Referring additionally now to FIG. 15, another fluid delivery device or jet sub 220 embodying principles of the present invention is representatively illustrated. The jet sub 220 includes a orifice member 222 which is threadedly installed into a generally tubular housing 224. A flat washer 232 seals the orifice member 222 to the housing 224. In the jet sub 220, fluid pressure is utilized to open an orifice 226 formed axially through the orifice member 222.

Fluid flow through the orifice 226 is blocked by an orifice plugging member 228. The plugging member 228 is sealingly and axially reciprocably received within the orifice member 222. A shear pin 230 releasably secures the plugging member 228 within the orifice member 222.

When fluid pressure within the interior of the housing 224 exceeds fluid pressure on the exterior of the housing by a predetermined amount, the shear pin 230 will shear and permit the plugging member 228 to be expelled outwardly from the orifice member 222. Expulsion of the plugging member 228 permits fluid to flow through the orifice 226.

One of the jet sub 220 may be utilized as each of the jet subs 174 in the method 170. After the tubing string 172 has been closed by, for example, installing the plug 178 within the nipple 176, fluid pressure within the tubing string may be increased to simultaneously shear the shear pin 230 in each of the jet subs 220. This fluid pressure is preferably predetermined to exceed the fluid pressure at which the stimulation fluid 180 is to be delivered to the formation 38*g*. With the plugging members 228 expelled from the orifice members 222, the stimulation fluid 180 may then be simultaneously flowed through the orifices 226 and to the desired stimulation locations 154*g*.

It is to be understood that each of the procedures described in each of the above methods 10, 80, 90, 110, 120, 140, 150 and 170 may be performed by utilizing a succession of varied tools and equipment without departing from the principles of the present invention. For example, when a tubing string, such as tubing string 42, is repeatedly inserted into and withdrawn from a work string, such as work string 18, the tubing string may be changed somewhat between each successive insertion or withdrawal by adding, eliminating, or substituting various components thereof. Such changes to work strings, tubing strings, etc. are contemplated by the applicants and are encompassed by the principles of the present invention.

Of course, modifications, additions, deletions, substitutions and other changes, which would be obvious to a person of ordinary skill in the art, may be made to the methods and apparatus described hereinabove, and such changes are contemplated by the principles of the present invention. Accordingly, the foregoing detailed description is to be clearly understood as being given by way of illustration and example only, the spirit and scope of the present invention being limited solely by the appended claims. For example, although each of the above-described methods 10, 80, 90, 110, 120, 140, 150 and 170 has been described as being performed in a generally horizontal portion of a well, it will be readily appreciated by one of ordinary skill in the art that the methods may also be performed in generally vertical or inclined well portions. As another example, although formation stimulation operations in each of the above-described methods 10, 80, 90, 110, 120, 140, 150 and 170 has been described as being performed in an uncased portion of a well, it will be readily appreciated by one of ordinary skill in the art that the methods may also be performed in cased well portions.

What is claimed is:

1. A method of stimulating a portion of a subterranean well at axially spaced apart desired stimulation locations therein, the well portion intersecting a formation, the method comprising the steps of:

disposing a viscous fluid within the well portion;

forming a radially extending opening through the viscous fluid at a first one of the desired stimulation locations; and flowing stimulation fluids through the opening and into the formation at the first desired stimulation location, whereby the viscous fluid substantially prevents flow of the stimulation fluids into any portion of the formation other than at the first desired stimulation location.

2. The method according to claim 1, wherein the opening forming step further comprises extending the opening into the formation.

3. The method according to claim 1, further comprising the step of providing the viscous fluid such that the viscous fluid is substantially gelatinous.

4. The method according to claim 1, further comprising the step of providing the viscous fluid such that the viscous fluid is capable of preventing fluid flow radially outward into the formation where the viscous fluid contacts the formation.

5. The method according to claim 1, further comprising the steps of providing a first tubular string, and positioning the first tubular string within the well.

6. The method according to claim 5, wherein the first tubular string positioning step comprises disposing an end of the first tubular string within the well portion.

7. The method according to claim 5, further comprising the steps of:

providing a second tubular string;

inserting the second tubular string into the first tubular string; and positioning the second tubular string relative to the end of the first tubular string.

8. The method according to claim 7, wherein the second tubular string providing step comprises providing a radially outwardly directed flow passage on the second tubular string, and wherein the opening forming step includes flowing a first fluid radially outward through the flow passage.

9. The method according to claim 8, wherein the flow passage providing step comprises providing a cutting device interconnected to the second tubular string.

10. The method according to claim 9, wherein the cutting device providing step comprises providing a hydraulic jet cutting head, and wherein the opening forming step further comprises forming a hole into the formation.

11. The method according to claim 7, wherein the second tubular string providing step further comprises providing a recloseable flow port, and wherein the stimulation fluid flowing step comprises flowing the stimulation fluid through the flow port.

12. The method according to claim 7, wherein the second tubular string providing step further comprises providing a positioning device interconnected to the remainder of the second tubular string, and wherein the second tubular string positioning step comprises activating the positioning device.

13. The method according to claim 12, wherein the positioning device providing step further comprises providing a latching device, wherein the first tubular string providing step further comprises providing a latching profile interconnected to the remainder of the first tubular string, and wherein the positioning device activating step comprises engaging the latching device with the latching profile.

14. The method according to claim 5, wherein the first tubular string providing step comprises providing a radially outwardly directed flow passage on the first tubular string, and wherein the opening forming step includes flowing a first fluid radially outward through the flow passage.

15. The method according to claim 14, wherein the flow passage providing step comprises providing a cutting device interconnected to the first tubular string.

16. The method according to claim 15, wherein the cutting device providing step comprises providing a hydraulic jet cutting head, and wherein the opening forming step further comprises forming a hole into the formation.

17. The method according to claim 13, wherein the first tubular string providing step further comprises providing a recloseable flow port, and wherein the stimulation fluid flowing step comprises flowing the stimulation fluid through the flow port.

18. The method according to claim 5, wherein the first tubular string providing step comprises providing a radially directed recloseable flow passage interconnected to the remainder of the first tubular string, and wherein the opening forming step includes opening the flow passage and flowing a first fluid radially outward through the flow passage.

19. The method according to claim 18, wherein the first fluid flowing step comprises disposing a second tubular string within the first tubular string, and flowing the first fluid through the second tubular string to the flow passage.

20. The method according to claim 19, wherein the second tubular string providing step comprises providing a cutting device interconnected to the second tubular string.

21. The method according to claim 20, wherein the cutting device providing step comprises providing a hydraulic jet cutting head, and wherein the opening forming step further comprises forming a hole into the formation.

22. The method according to claim 5, wherein the first tubular string providing step comprises providing a series of axially spaced apart seals externally connected to the remainder of the first tubular string.

23. The method according to claim 22, further comprising the steps of:

providing a packer having an axially extending seal bore formed therethrough; and setting the packer within the well.

24. The method according to claim 23, further comprising the step of inserting the first tubular string axially through the packer, such that one of the seals sealingly engages the seal bore.

25. The method according to claim 24, wherein the first tubular string positioning step comprises spacing apart the seals so that each of the desired stimulation locations corresponds to one of the seals when the one of the seals sealingly engages the seal bore.

26. The method according to claim 24, wherein the opening forming step comprises providing a second tubular string, disposing the second tubular string within the first tubular string, and flowing a first fluid through the second tubular string to the well portion.

27. The method according to claim 26, wherein the second tubular string providing step comprises providing a cutting device interconnected to the remainder of the second tubular string.

28. The method according to claim 27, wherein the cutting device providing step comprises providing a hydraulic jet cutting head, and wherein the opening forming step further comprises forming a hole into the formation.

29. The method according to claim 5, wherein the subterranean well includes a cased portion, and wherein the first tubular string positioning step comprises forming a first annulus radially between the first tubular string and the cased portion, and forming a second annulus radially between the first tubular string and the well portion.

30. The method according to claim 29, wherein the viscous fluid disposing step comprises contacting substantially all of the formation exposed to the second annulus with the viscous fluid.

31. The method according to claim 29, wherein the viscous fluid disposing step comprises flowing the viscous fluid from the earth's surface, through the first tubular string, and into the second annulus.

32. The method according to claim 29, wherein the viscous fluid disposing step comprises flowing the viscous fluid into the first annulus.

33. The method according to claim 5, further comprising the steps of:

axially displacing the first tubular string relative to the well portion after the stimulation fluids flowing step, the axially displacing step forming a void in the viscous fluid in the well portion; and filling the void with the viscous fluid.

34. The method according to claim 33, wherein the void filling step comprises applying pressure to an annulus formed radially between a cased portion of the well and the first tubular string at the earth's surface.

35. The method according to claim 34, wherein the viscous fluid disposing step comprises disposing the viscous fluid within the annulus.

36. The method according to claim 35, wherein the pressure applying step comprises flowing a portion of the viscous fluid from the annulus into the well portion.

37. The method according to claim 1, further comprising the step of filling the opening with a plug.

38. The method according to claim 37, wherein the opening filling step comprises filling the opening with the viscous fluid.

39. The method according to claim 37, wherein the opening filling step comprises filling the opening with a mixture of the viscous fluid and a granular material.

40. A method of injecting a fluid into successive desired locations in a formation surrounding a subterranean wellbore while preventing the injection of the fluid into other locations in the formation exposed to the wellbore, the method comprising the steps of:

contacting the formation exposed to the wellbore with a flowable material, the material being capable of flowing within the wellbore and substantially incapable of flowing into the formation;

providing a tubular member;

disposing an end of the tubular member in the flowable material;

forming a first flow passage from the tubular member through the flowable material to a first one of the desired locations in the formation; and flowing the fluid through the tubular member and the first flow passage to the first one of the desired locations.

41. The method according to claim 40, further comprising the steps of:

closing the first flow passage;

forming a second flow passage from the tubular member through the flowable material to a second one of the desired locations in the formation; and flowing the fluid through the tubular member and the second flow passage to the second one of the desired locations.

42. The method according to claim 41, wherein the step of closing the first flow passage comprises flowing the flowable material into the first flow passage.

43. The method according to claim 42, wherein the step of flowing the flowable material into the first flow passage comprises mixing sand with the flowable material flowed into the first flow passage.

44. The method according to claim 41, further comprising the step of displacing the tubular member relative to the formation before performing the step of forming the second flow passage.

45. The method according to claim 44, further comprising the step of applying pressure to the flowable material after the displacing step, the pressure applying step reconsolidating the flowable material.

46. A method of stimulating a formation intersecting a subterranean well, the method comprising the steps of:

providing a work string having an end;

disposing the work string within the subterranean well;

providing a viscous fluid;

disposing the viscous fluid in the subterranean well about the work string end, the viscous fluid contacting the formation;

providing a tubing string having an end and a cutting head attached to the tubing string end;

disposing the tubing string within the work string;

positioning the tubing string end relative to the work string end, such that the cutting head extends axially outward from the work string end;

forming an opening from the cutting head to the formation through the viscous fluid; and flowing stimulation fluid through the opening to the formation.

47. The method according to claim 46, wherein the stimulation fluid flowing step comprises flowing the stimulation fluid through the work string.

48. The method according to claim 46, wherein the tubing string providing step comprises providing a ported sub connected to the remainder of the tubing string, and wherein the stimulation fluid flowing step comprises extending the ported sub axially outward from the work string end, opening flow ports on the ported sub, and flowing the stimulation fluid through the tubing string and outward through the flow ports.

49. The method according to claim 46, wherein the work string and the tubing string providing steps further comprise providing mutually engageable positioning devices on each of the work string and the tubing string, the mutually engageable positioning devices permitting the positioning step to be performed by engaging the mutually engageable positioning devices with each other.

50. The method according to claim 46, wherein the viscous fluid disposing step comprises flowing the viscous fluid through the work string to the formation.

51. A method of stimulating a formation intersecting a subterranean well, the method comprising the steps of:

providing a work string having an end and a cutting head attached to the end;

disposing the work string within the subterranean well;

providing a viscous fluid;

disposing the viscous fluid in the subterranean well about the work string end, the viscous fluid contacting the formation;

forming a first opening from the cutting head to the formation through the viscous fluid; and flowing stimulation fluid through the first opening to the formation.

52. The method according to claim 51, wherein the stimulation fluid flowing step comprises flowing the stimulation fluid through the work string.

53. The method according to claim 51, wherein the work string providing step comprises providing a ported sub connected to the remainder of the work string, and wherein the stimulation fluid flowing step comprises opening flow ports on the ported sub, and flowing the stimulation fluid through the work string and outward through the flow ports.

54. The method according to claim 51, further comprising the steps of:

closing the opening by flowing the viscous fluid into the opening;

displacing the work string relative to the formation;

forming a second opening from the cutting head to the formation through the viscous fluid; and flowing stimulation fluid through the second opening to the formation.

55. The method according to claim 51, wherein the viscous fluid disposing step comprises flowing the viscous fluid through the work string to the formation.

56. A method of stimulating a formation intersecting a subterranean well, the method comprising the steps of:

providing a work string having an end and an axially spaced apart series of seals externally disposed on an outer side surface of the work string;

providing a packer having a seal bore;

setting the packer in the well;

disposing the work string within the subterranean well, the work string being reciprocably received in the seal bore;

providing a viscous fluid;

disposing the viscous fluid in the subterranean well about the work string end, the viscous fluid contacting the formation;

providing a tubing string having an end and a cutting head attached to the tubing string end;

disposing the tubing string within the work string;

positioning the tubing string end relative to the work string end, such that the cutting head extends axially outward from the work string end;

sealingly engaging one of the seals with the seal bore;

forming a first opening from the cutting head to the formation through the viscous fluid; and flowing stimulation fluid through the first opening to the formation.

57. The method according to claim 56, wherein the stimulation fluid flowing step comprises withdrawing the tubing string from within the work string and flowing the stimulation fluid through the work string.

58. The method according to claim 56, wherein the tubing string providing step comprises providing a ported sub connected to the remainder of the tubing string, and wherein the stimulation fluid flowing step comprises extending the ported sub axially outward from the work string end, opening flow ports on the ported sub, and flowing the stimulation fluid through the tubing string and outward through the flow ports.

59. The method according to claim 56, wherein the work string and the tubing string providing steps further comprise providing mutually engageable positioning devices on each of the work string and the tubing string, the mutually engageable positioning devices permitting the positioning step to be performed by engaging the mutually engageable positioning devices with each other.

60. The method according to claim 56, further comprising the steps of:

displacing the work string relative to the formation, thereby releasing the one of the seals from sealing engagement with the seal bore;

closing the first opening by flowing the viscous fluid into the first opening;

displacing the work string such that another of the seals sealingly engages the seal bore;

forming a second opening from the cutting head to the formation through the viscous fluid; and flowing stimulation fluid through the second opening to the formation.

61. A method of stimulating a formation intersecting a subterranean well, the method comprising the steps of:

providing a work string having an axially spaced apart series of sliding sleeves connected to the remainder of the work string;

disposing the work string within the subterranean well;

positioning the work string within the subterranean well such that each of the sliding sleeves is radially opposite a desired stimulation location in the formation;

providing a viscous fluid;

disposing the viscous fluid in the subterranean well about the work string end, the viscous fluid contacting the formation;

providing a tubing string having an end and a cutting head attached to the tubing string end;

opening a first one of the sliding sleeves;

disposing the tubing string within the work string;

positioning the tubing string end relative to the work string end, such that the cutting head is aligned with the first one of the sliding sleeves;

forming a first opening from the cutting head to the formation through the first one of the sliding sleeves and the viscous fluid; and flowing stimulation fluid through the first opening to the formation.

62. The method according to claim 61, wherein the stimulation fluid flowing step comprises flowing the stimulation fluid through the work string and through the first one of the sliding sleeves.

63. The method according to claim 61, further comprising the steps of:

closing the first one of the sliding sleeves;

opening a second one of the sliding sleeves;

positioning the tubing string end relative to the work string end, such that the cutting head is aligned with the second one of the sliding sleeves;

forming a second opening from the cutting head to the formation through the second one of the sliding sleeves and the viscous fluid; and flowing stimulation fluid through the second opening to the formation.

64. A method of stimulating a formation intersecting a subterranean well, the method comprising the steps of:

providing a tubular string having an end;

disposing the tubular string within the subterranean well, thereby forming an annulus between the tubular string and the well;

providing a viscous fluid;

disposing the viscous fluid in the subterranean well about the tubular string end in a first portion of the annulus, the viscous fluid contacting the formation;

sealingly engaging the tubular string With the subterranean well, thereby isolating the first annulus portion from a second annulus portion;

forming a first opening to the formation through the viscous fluid; and flowing stimulation fluid through the first opening to the formation.

65. The method according to claim 64, wherein the sealingly engaging step comprises setting a packer in the subterranean well, the packer being attached to the tubular string.

66. The method according to claim 65, further comprising the steps of:

unsetting the packer;

then axially displacing the tubular string relative to the subterranean well;

then setting the packer in the subterranean well;

then forming a second opening to the formation through the viscous fluid; and then flowing stimulation fluid through the second opening to the formation.

67. The method according to claim 64, wherein the sealingly engaging step comprises setting a packer in the subterranean well, the packer having seals attached thereto capable of sealingly engaging the tubular string.

68. The method according to claim 67, wherein the sealingly engaging step further comprises inserting the tubular string through the packer, thereby sealingly engaging the tubular string with the seals.

69. The method according to claim 67, further comprising the step of closing a bypass port attached to the packer, the bypass port thereby preventing fluid communication between the first and second annulus portions.

70. The method according to claim 69, further comprising the steps of:

opening the bypass port;

then axially displacing the tubular string relative to the subterranean well;

then closing the bypass port;

then forming a second opening to the formation through the viscous fluid; and then flowing stimulation fluid through the second opening to the formation.

71. A method of stimulating a portion of a subterranean well at desired stimulation locations therein, the well portion intersecting a formation, the method comprising the steps of:

disposing a barrier fluid within the well portion; and flowing stimulation fluids through the barrier fluid and into the formation at a first one of the desired stimulation locations, whereby the barrier fluid substantially prevents flow of the stimulation fluids into a portion of the formation other than at the first desired stimulation location.

72. The method according to claim 71, further comprising the step of providing the barrier fluid such that the barrier fluid is substantially gelatinous.

73. The method according to claim 71, further comprising the step of providing the barrier fluid such that the barrier fluid is capable of preventing fluid flow radially outward into the formation where the barrier fluid contacts the formation.

74. The method according to claim 71, further comprising the steps of providing a tubular string, and positioning the tubular string within the well.

75. The method according to claim 74, wherein the tubular string positioning step comprises disposing an end of the tubular string within the well portion.

76. The method according to claim 74, wherein the barrier fluid disposing step further comprises flowing the barrier fluid through the tubular string.

77. The method according to claim 76, wherein the barrier fluid disposing step further comprises flowing the barrier fluid into an annulus formed radially between the tubular string and the formation in the well portion.

78. The method according to claim 75, wherein the stimulation fluid flowing step further comprises forming an opening through the barrier fluid from the tubular string end to the formation.

79. The method according to claim 78, further comprising the step of displacing the tubular string axially within the well portion after the stimulation fluid flowing step.

80. The method according to claim 79, further comprising the step of flowing barrier fluid into the opening.

81. The method according to claim 80, wherein the barrier fluid flowing step is performed after the tubular string displacing step.

82. The method according to claim 81, wherein the tubular string displacing step further comprises forming a void in the barrier fluid in the well portion from the opening to the tubular string end, and wherein the barrier fluid flowing step further comprises flowing barrier fluid into the void.

83. The method according to claim 82, wherein the tubular string displacing step further comprises displacing the tubular string to a second desired stimulation location in the well portion.

84. The method according to claim 83, further comprising the step of flowing stimulation fluids through the barrier fluid and into the formation at the second desired stimulation location.

85. The method according to claim 84, wherein the step of flowing stimulation fluids into the formation at the second desired stimulation location is performed after flowing barrier fluid into an opening formed by the step of flowing stimulation fluids into the formation at the first desired stimulation location.

86. The method according to claim 71, wherein the barrier fluid is permitted to hydrate before the stimulation fluid flowing step.

87. The method according to claim 71, wherein the barrier fluid is permitted to become gelatinous before the stimulation fluid flowing step.

88. The method according to claim 71, wherein the barrier fluid is permitted to set before the stimulation fluid flowing step.

89. The method according to claim 71, further comprising the step of permitting the barrier fluid to become more viscous in the well portion.

90. The method according to claim 89, wherein the permitting step is performed prior to the stimulation fluid flowing step.

91. The method according to claim 74, wherein the tubular string providing step further comprises providing the tubular string having a plurality of fluid delivery devices interconnected therein.

92. The method according to claim 91, wherein the tubular string positioning step further comprises positioning each of the fluid delivery devices opposite a corresponding one of the desired stimulation locations.

93. The method according to claim 91, wherein the tubular string positioning step further comprises positioning at least one of the fluid delivery devices opposite each of the desired stimulation locations.

94. The method according to claim 91, wherein the stimulation fluid flowing step further comprises flowing the stimulation fluid through at least one of the fluid delivery devices.

95. The method according to claim 91, further comprising the step of conveying a plugging device through the tubular string to thereby block fluid flow through an end of the tubular string positioned within the well portion.

96. The method according to claim 91, wherein the fluid delivery devices providing step further comprises providing at least one of the fluid delivery devices having an orifice plugging device, the orifice plugging device selectively preventing fluid flow through an orifice extending through a sidewall portion of the at least one fluid delivery device.

97. The method according to claim 96, wherein in the fluid delivery devices providing step, the orifice plugging device is releasably secured in a position preventing fluid flow through the orifice.

98. The method according to claim 97, wherein in the fluid delivery devices providing step, the orifice plugging device is releasably secured by a shear member.

99. The method according to claim 98, further comprising the step of shearing the shear member by applying a differential pressure across the sidewall portion of the at least one fluid delivery device.

100. The method according to claim 91, wherein the fluid delivery devices providing step further comprises providing each of the fluid delivery devices having an orifice plugging device, each of the orifice plugging devices selectively preventing fluid flow through an orifice of each of the fluid delivery devices.

101. The method according to claim 100, further comprising the step of substantially simultaneously actuating the orifice plugging devices to thereby permit fluid flow through each of the orifices.

102. The method according to claim 100, further comprising the step of dissolving at least a portion of each of the orifice plugging devices to thereby permit fluid flow through each of the orifices.

103. The method according to claim 100, wherein at least one of the orifice plugging devices includes a portion thereof which is dissolvable to thereby permit fluid flow therethrough.

104. The method according to claim 103, further comprising the step of dissolving the portion of the at least one orifice plugging device.

105. The method according to claim 71, wherein the disposing step further comprises utilizing at least one centralizer to distribute the barrier fluid within the well portion.

106. A method of injecting a fluid into successive desired locations in a formation surrounding a subterranean wellbore while preventing the injection of the fluid into other locations in the formation exposed to the wellbore, the method comprising the steps of:

providing a tubular member;

disposing the tubular member in the wellbore proximate a first one of the desired locations;

contacting the formation exposed to the wellbore with a first quantity of barrier material, the material being at least initially capable of flowing within the wellbore and substantially incapable of flowing into the formation; and flowing the fluid through the tubular member, through the first quantity of barrier material, and to the first one of the desired locations, the barrier material preventing the fluid from flowing into any portion of the formation other than at the first one of the desired locations.

107. The method according to claim 106, wherein the contacting step further comprises flowing the first quantity of barrier material through the tubular member to an annulus formed radially between the tubular member and the formation.

108. The method according to claim 106, wherein the fluid flowing step further comprises forming an opening through the first quantity of barrier material from the tubular member to the formation.

109. The method according to claim 108, further comprising the step of flowing a second quantity of barrier material into the opening.

110. The method according to claim 109, further comprising the step of displacing the tubular member relative to the formation before performing the step of flowing the second quantity of barrier material into the opening.

111. The method according to claim 109, further comprising the step of displacing the tubular member relative to the formation to a position proximate a second one of the desired locations.

112. The method according to claim 106, further comprising the steps of:

displacing the tubular member in the wellbore to a location proximate a second one of the desired locations;

flowing a second quantity of barrier material through the tubular member, into an opening formed through the first quantity of barrier material in the fluid flowing step, and into a void created in the first quantity of barrier material in the tubular member displacing step; and flowing the fluid through the tubular member, through the first quantity of barrier material, and to the second one of the desired locations.

113. A method of stimulating a formation intersecting a subterranean well, the method comprising the steps of:

providing a tubing string including a plurality of fluid delivery devices;

disposing the tubing string within the subterranean well, the fluid delivery devices being positioned opposite the formation;

providing a barrier fluid;

disposing the barrier fluid in the subterranean well about the tubing string, the barrier fluid contacting the formation; and flowing stimulation fluid through the fluid delivery devices to the formation through the barrier fluid.

114. The method according to claim 113, wherein the stimulation fluid flowing step further comprises flowing the stimulation fluid through the tubing string, and wherein the barrier fluid disposing step further comprises flowing the barrier fluid through the tubing string.

115. The method according to claim 114, further comprising the step of plugging the tubing string to thereby direct fluid flow through the fluid delivery devices.

116. The method according to claim 115, wherein the plugging step is performed after the barrier fluid disposing step and before the stimulation fluid flowing step.

117. The method according to claim 113, wherein the stimulation fluid flowing step further comprises substantially simultaneously flowing the stimulation fluid through each of the fluid delivery devices.

118. The method according to claim 113, wherein in the tubing string providing step, at least one of the fluid delivery devices includes an orifice and an orifice plugging member, the orifice plugging member preventing fluid flow through the orifice.

119. The method according to claim 118, further comprising the step of opening the orifice to fluid flow therethrough.

120. The method according to claim 119, wherein the orifice opening step further comprises shearing a shear member releasably securing the orifice plugging member relative to the orifice.

121. The method according to claim 119, wherein the orifice opening step further comprises contacting the orifice plugging member with the stimulation fluid.

122. The method according to claim 119, wherein the orifice opening step further comprises dissolving at least a portion of the orifice plugging member.

* * * * *